US008630757B2

(12) United States Patent
Daum et al.

(10) Patent No.: US 8,630,757 B2
(45) Date of Patent: Jan. 14, 2014

(54) SYSTEM AND METHOD FOR OPTIMIZING PARAMETERS OF MULTIPLE RAIL VEHICLES OPERATING OVER MULTIPLE INTERSECTING RAILROAD NETWORKS

(75) Inventors: Wolfgang Daum, Erie, PA (US); Evren Eryurek, Melbourne, FL (US); Glenn Robert Shaffer, Erie, PA (US)

(73) Assignee: General Electric Company, Schenectady, NY (US)

( * ) Notice: Subject to any disclaimer, the term of this patent is extended or adjusted under 35 U.S.C. 154(b) by 1091 days.

(21) Appl. No.: 11/831,492

(22) Filed: Jul. 31, 2007

(65) Prior Publication Data

US 2008/0033605 A1 Feb. 7, 2008

Related U.S. Application Data

(63) Continuation-in-part of application No. 11/385,354, filed on Mar. 20, 2006.

(60) Provisional application No. 60/849,101, filed on Oct. 2, 2006, provisional application No. 60/939,851, filed on May 23, 2007.

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.

USPC ..... 701/19; 701/20

(58) Field of Classification Search

USPC ..... 701/19, 20; 246/186, 187 R, 187 A, 246/187 B

See application file for complete search history.

(56) References Cited

U.S. PATENT DOCUMENTS

| | | | | |
|---|---|---|---|---|
| 2,104,601 | A * | 1/1938 | Young | 246/114 R |
| 2,111,513 | A * | 3/1938 | Phinney | 246/134 |
| 2,148,005 | A * | 2/1939 | Allen et al. | 246/114 R |

(Continued)

FOREIGN PATENT DOCUMENTS

| | | |
|---|---|---|
| DE | 19654960 A1 | 7/1998 |
| EP | 1293948 A2 | 3/2003 |

(Continued)

OTHER PUBLICATIONS

Japanese Office Action for corresponding JP Application No. 2009-530500, dated for Apr. 3, 2012.

(Continued)

*Primary Examiner* — Khoi Tran
*Assistant Examiner* — Jorge Peche
(74) *Attorney, Agent, or Firm* — GE Global Patent Operation; John A. Kramer

(57) ABSTRACT

In a railway network a method for linking at least one of train parameters, fuel efficiency emission efficiency, and load with network knowledge so that adjustments for network efficiency may be made as time progresses while a train is performing a mission. The method includes dividing the train mission into multiple sections with common intersection points, and calculating train operating parameters based on other trains in a railway network to determine optimized parameters over a certain section. The method further includes comparing optimized parameters to current operating parameters, and altering current operating parameters of the train to coincide with optimized parameters for at least one of the current track section and a pending track section.

18 Claims, 13 Drawing Sheets

(56) References Cited

U.S. PATENT DOCUMENTS

| | | | | | |
|---|---|---|---|---|---|
| 2,233,932 | A | * | 3/1941 | Allen | 246/114 R |
| 2,289,857 | A | * | 7/1942 | Allen | 246/114 R |
| 2,293,926 | A | * | 8/1942 | Wallace | 246/114 R |
| 2,366,802 | A | * | 1/1945 | Pflasterer | 246/114 R |
| 3,508,496 | A | * | 4/1970 | Larson | 104/130.04 |
| 3,519,805 | A | | 7/1970 | Thorne-Booth | |
| 3,537,401 | A | * | 11/1970 | Metzner | 104/299 |
| 3,575,596 | A | * | 4/1971 | Schatzel | 246/114 R |
| 3,650,216 | A | | 3/1972 | Harwick et al. | |
| 3,655,962 | A | | 4/1972 | Koch | |
| 3,813,885 | A | * | 6/1974 | Tabor | 405/132 |
| 3,865,042 | A | | 2/1975 | DePaola et al. | |
| 4,005,838 | A | | 2/1977 | Grundy | |
| 4,041,283 | A | | 8/1977 | Mosier | |
| 4,042,810 | A | | 8/1977 | Mosher | |
| 4,181,943 | A | | 1/1980 | Mercer, Sr. | |
| 4,253,399 | A | | 3/1981 | Spigarelli | |
| 4,279,395 | A | | 7/1981 | Boggio et al. | |
| 4,324,376 | A | * | 4/1982 | Kuhn | 246/125 |
| 4,344,364 | A | | 8/1982 | Nickles et al. | |
| 4,401,035 | A | | 8/1983 | Spigarelli et al. | |
| 4,561,057 | A | | 12/1985 | Haley, Jr. et al. | |
| 4,602,335 | A | | 7/1986 | Perlmutter | |
| 4,711,418 | A | | 12/1987 | Aver, Jr. et al. | |
| 4,735,385 | A | | 4/1988 | Nickles et al. | |
| 4,794,548 | A | | 12/1988 | Lynch et al. | |
| 4,827,438 | A | | 5/1989 | Nickles et al. | |
| 4,853,883 | A | | 8/1989 | Nickles et al. | |
| 5,109,343 | A | | 4/1992 | Budway | |
| 5,398,894 | A | | 3/1995 | Pascoe | |
| 5,437,422 | A | | 8/1995 | Newman | |
| 5,440,489 | A | | 8/1995 | Newman | |
| 5,487,516 | A | * | 1/1996 | Murata et al. | 246/182 C |
| 5,676,059 | A | | 10/1997 | Alt | |
| 5,699,986 | A | * | 12/1997 | Welk | 246/125 |
| 5,735,492 | A | * | 4/1998 | Pace | 246/125 |
| 5,744,707 | A | | 4/1998 | Kull | |
| 5,758,299 | A | | 5/1998 | Sandborg et al. | |
| 5,785,392 | A | | 7/1998 | Hart | |
| 5,828,979 | A | | 10/1998 | Polivka et al. | |
| 5,890,682 | A | * | 4/1999 | Welk | 246/125 |
| 5,936,517 | A | * | 8/1999 | Yeh | 340/435 |
| 5,950,967 | A | | 9/1999 | Montgomery | |
| 6,112,142 | A | | 8/2000 | Shockley et al. | |
| 6,125,311 | A | | 9/2000 | Lo | |
| 6,129,025 | A | * | 10/2000 | Minakami et al. | 104/88.01 |
| 6,144,901 | A | | 11/2000 | Nickles et al. | |
| 6,179,252 | B1 | * | 1/2001 | Roop et al. | 246/293 |
| 6,230,668 | B1 | | 5/2001 | Marsh et al. | |
| 6,269,034 | B1 | | 7/2001 | Shibuya | |
| 6,308,117 | B1 | | 10/2001 | Ryland et al. | |
| 6,487,488 | B1 | | 11/2002 | Peterson, Jr. et al. | |
| 6,505,103 | B1 | | 1/2003 | Howell et al. | |
| 6,516,727 | B2 | | 2/2003 | Kraft | |
| 6,591,758 | B2 | | 7/2003 | Kumar | |
| 6,609,049 | B1 | | 8/2003 | Kane et al. | |
| 6,612,245 | B2 | | 9/2003 | Kumar et al. | |
| 6,612,246 | B2 | | 9/2003 | Kumar | |
| 6,615,118 | B2 | | 9/2003 | Kumar | |
| 6,691,957 | B2 | | 2/2004 | Hess, Jr. et al. | |
| 6,694,231 | B1 | | 2/2004 | Rezk | |
| 6,732,023 | B2 | * | 5/2004 | Sugita et al. | 701/19 |
| 6,763,291 | B1 | | 7/2004 | Houpt et al. | |
| 6,789,005 | B2 | | 9/2004 | Hawthorne | |
| 6,810,312 | B2 | | 10/2004 | Jammu et al. | |
| 6,824,110 | B2 | | 11/2004 | Kane et al. | |
| 6,845,953 | B2 | | 1/2005 | Kane et al. | |
| 6,853,888 | B2 | | 2/2005 | Kane et al. | |
| 6,856,865 | B2 | | 2/2005 | Hawthorne | |
| 6,863,246 | B2 | | 3/2005 | Kane et al. | |
| 6,865,454 | B2 | | 3/2005 | Kane et al. | |
| 6,903,658 | B2 | | 6/2005 | Kane et al. | |
| 6,915,191 | B2 | | 7/2005 | Kane et al. | |
| 6,922,619 | B2 | | 7/2005 | Baig et al. | |
| 6,957,131 | B2 | | 10/2005 | Kane et al. | |
| 6,978,195 | B2 | | 12/2005 | Kane et al. | |
| 6,980,894 | B1 | | 12/2005 | Gordon et al. | |
| 6,996,461 | B2 | | 2/2006 | Kane et al. | |
| 7,021,588 | B2 | * | 4/2006 | Hess et al. | 246/186 |
| 7,021,589 | B2 | | 4/2006 | Hess, Jr. et al. | |
| 7,024,289 | B2 | | 4/2006 | Kane et al. | |
| 7,036,774 | B2 | | 5/2006 | Kane et al. | |
| 7,079,926 | B2 | | 7/2006 | Kane et al. | |
| 7,092,800 | B2 | | 8/2006 | Kane et al. | |
| 7,092,801 | B2 | | 8/2006 | Kane et al. | |
| 7,096,171 | B2 | * | 8/2006 | Hawthorne et al. | 703/8 |
| 7,131,403 | B1 | | 11/2006 | Banga et al. | |
| 2002/0059075 | A1 | | 5/2002 | Schick et al. | |
| 2002/0096081 | A1 | | 7/2002 | Kraft | |
| 2002/0174653 | A1 | | 11/2002 | Uzkan | |
| 2002/0188397 | A1 | * | 12/2002 | Biess et al. | 701/112 |
| 2003/0105561 | A1 | * | 6/2003 | Nickles et al. | 701/19 |
| 2003/0213875 | A1 | | 11/2003 | Hess, Jr. et al. | |
| 2004/0133315 | A1 | | 7/2004 | Kumar et al. | |
| 2004/0245410 | A1 | | 12/2004 | Kisak et al. | |
| 2004/0249571 | A1 | * | 12/2004 | Blesener et al. | 701/301 |
| 2005/0065674 | A1 | | 3/2005 | Houpt et al. | |
| 2005/0120904 | A1 | * | 6/2005 | Kumar et al. | 105/35 |
| 2005/0189815 | A1 | * | 9/2005 | Bryant | 303/7 |
| 2005/0234757 | A1 | * | 10/2005 | Matheson et al. | 705/8 |
| 2006/0060345 | A1 | | 3/2006 | Flik et al. | |
| 2006/0085103 | A1 | * | 4/2006 | Smith et al. | 701/19 |
| 2006/0129289 | A1 | * | 6/2006 | Kumar et al. | 701/29 |
| 2006/0212188 | A1 | * | 9/2006 | Kickbusch et al. | 701/19 |
| 2006/0277906 | A1 | | 12/2006 | Burk et al. | |
| 2007/0219680 | A1 | | 9/2007 | Kumar et al. | |
| 2007/0274158 | A1 | * | 11/2007 | Agam et al. | 367/96 |

FOREIGN PATENT DOCUMENTS

| | | | |
|---|---|---|---|
| EP | 1 297 982 | | 4/2003 |
| JP | 7132832 | A | 5/1995 |
| JP | 2002204507 | A | 7/2002 |
| JP | 2002-249049 | | 9/2002 |
| JP | 2003095109 | A | 4/2003 |

OTHER PUBLICATIONS

European Search Report and Written Opinion issued in connection with corresponding EP Application No. 11187312.1-1810 on Oct. 23, 2013.

* cited by examiner

SYSTEM AND METHOD FOR OPTIMIZING PARAMETERS OF MULTIPLE RAIL VEHICLES OPERATING OVER MULTIPLE INTERSECTING RAILROAD NETWORKS

CROSS-REFERENCE TO RELATED APPLICATIONS

This application claims priority on and is a Continuation-In-Part of U.S. application Ser. No. 11/385,354 filed Mar. 20, 2006, which is incorporated herein by reference. The present application also is based on and claims priority from U.S. Provisional Application No. 60/849,101 filed Oct. 2, 2006 and U.S. Provisional Application No. 60/939,851 filed May 23, 2007.

FIELD OF INVENTION

The field of invention is directed towards operations of rail vehicles, such as trains and, more particularly, towards optimizing parameters, such as train operating parameters, fuel efficiency, emissions efficiency, and time of arrival, of multiple trains as they operate over an intersecting railroad network.

BACKGROUND OF THE INVENTION

Locomotives are complex systems with numerous subsystems, with each subsystem being interdependent on other subsystems. An operator is aboard a locomotive to ensure the proper operation of the locomotive and its associated load of freight cars. In addition to ensuring proper operations of the locomotive, the operator also is responsible for determining operating speeds of the train and forces within the train that the locomotives are part of. To perform this function, the operator generally must have extensive experience with operating the locomotive and various trains over the specified terrain. This knowledge is needed to comply with prescribeable operating speeds that may vary with the train location along the track. Moreover, the operator is also responsible for assuring in-train forces remain within acceptable limits.

Based on a particular train mission, it is common practice to provide a range of locomotives to power the train, depending on available power and run history. This leads to a large variation of available locomotive power for an individual train. Additionally, for critical trains, such as Z-trains, backup power, typically backup locomotives, is typically provided to cover the event of equipment failure and ensure that the train reaches its destination on time.

When operating a train, train operators typically call for the same notch setting based on previous operations of like train over the same track, which in turn leads to a large variation in fuel consumption since the trains are not exactly alike. Thus the operator cannot usually operate the locomotives so that the fuel consumption is minimized for each trip. This is difficult to do since, as an example, the size and loading of trains vary, and locomotives and their fuel/emissions characteristics are different.

Typically, once a train is composed and once it leaves the rail yard, or hump yard, the train dynamics, such as fuel efficiency versus speed, maximum acceleration and track conditions as well as track permissions, are generally known to the train and crew. However, the train operates in a network of railroad tracks with multiple trains running concurrently where tracks in the network of railroad tracks intersect and/or trains must navigate meet/pass track along a route. The network knowledge such as the time of arrival, scheduling of new trains and crews, as well as overall network health, is known at a central location, or distributed place, such as the dispatch center but not aboard the train. It is desirable to combine the local train knowledge with global network knowledge to determine an optimized system performance for each train in a railroad network. Towards this end, in a railroad network, operators would benefit from an optimized fuel efficiency and/or emissions efficiency and time of arrival for the overall network of multiple intersecting tracks and trains.

BRIEF DESCRIPTION OF THE INVENTION

Exemplary embodiment of the invention disclose a system, method, and computer software code for optimizing parameters, such as but not limited to fuel efficiency, emission efficiency, and time of arrival, of multiple trains as they operate over an intersecting railroad network. Towards this end, in a railway network a method for linking at least one of train parameters, fuel efficiency emission efficiency, and load with network knowledge so that adjustments for network efficiency may be made as time progresses while a train is performing a mission is disclosed. The method includes dividing the train mission into multiple sections with common intersection points. Another step involves calculating train operating parameters based on other trains in a railway network to determine optimized parameters over a certain section. Optimized parameters are compared to current operating parameters. Another step disclosed is altering current operating parameters of the train to coincide with optimized parameters for at least one of the current track section and a pending track section.

In another exemplary embodiment, a system for linking train parameters, fuel efficiency and load with network knowledge so that adjustments for network efficiency may be made as time progresses is disclosed. The system includes a network optimizer that determines optimum operating conditions for a plurality of trains within a railway network over segments of each train's mission. A wireless communication system for communicating between the network optimizer and a train is further disclosed. A data collection system that provides operational conditions about the train to the network optimizer is also disclosed.

In yet another embodiment a computer software code for linking train parameters, fuel efficiency and load with network knowledge so that adjustments for network efficiency may be made as time progresses is disclosed. The computer software code includes a computer software module for dividing a train mission into multiple sections with common intersection points. A computer software module for calculating train operating parameters based on other trains in a railway network to determine optimized parameters over a certain section is also included. A computer software module for comparing optimized parameters to current operating parameters is further disclosed. A computer software module for altering current operating parameters of the train to coincide with optimized parameters for at least one of the current section and a future section is also disclosed.

In another exemplary embodiment, a method of optimizing train operations using a network optimizer and an on-board trip optimizer is disclosed. The method includes a step for providing a train an initial set of train parameters from the network optimizer. A step for motoring the train through a mission, and a step for reporting train operating conditions to the network optimizer as the train progresses through the mission. A step is also provided for, on-board the train, considering real-time operational conditions of the train in view of the network optimizer provided train parameters. If the train parameters established by the network optimizer exceed limitations realized on-board the train, another step provides for overriding the train parameters provided by the network optimizer.

In a railway network having a plurality of tracks some which intersect with other tracks in the network, a method for optimizing rail vehicles operating within the railway network is disclosed. The method includes a step for determining a mission objective for each rail vehicle at a beginning of each respective mission. Another step is provided for determining an optimized trip plan for each rail vehicle based on the mission objective. Each respective trip plan is adjusted while motoring based on at least one of a respective rail vehicle's operating parameters and other rail vehicles proximate another rail vehicle.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
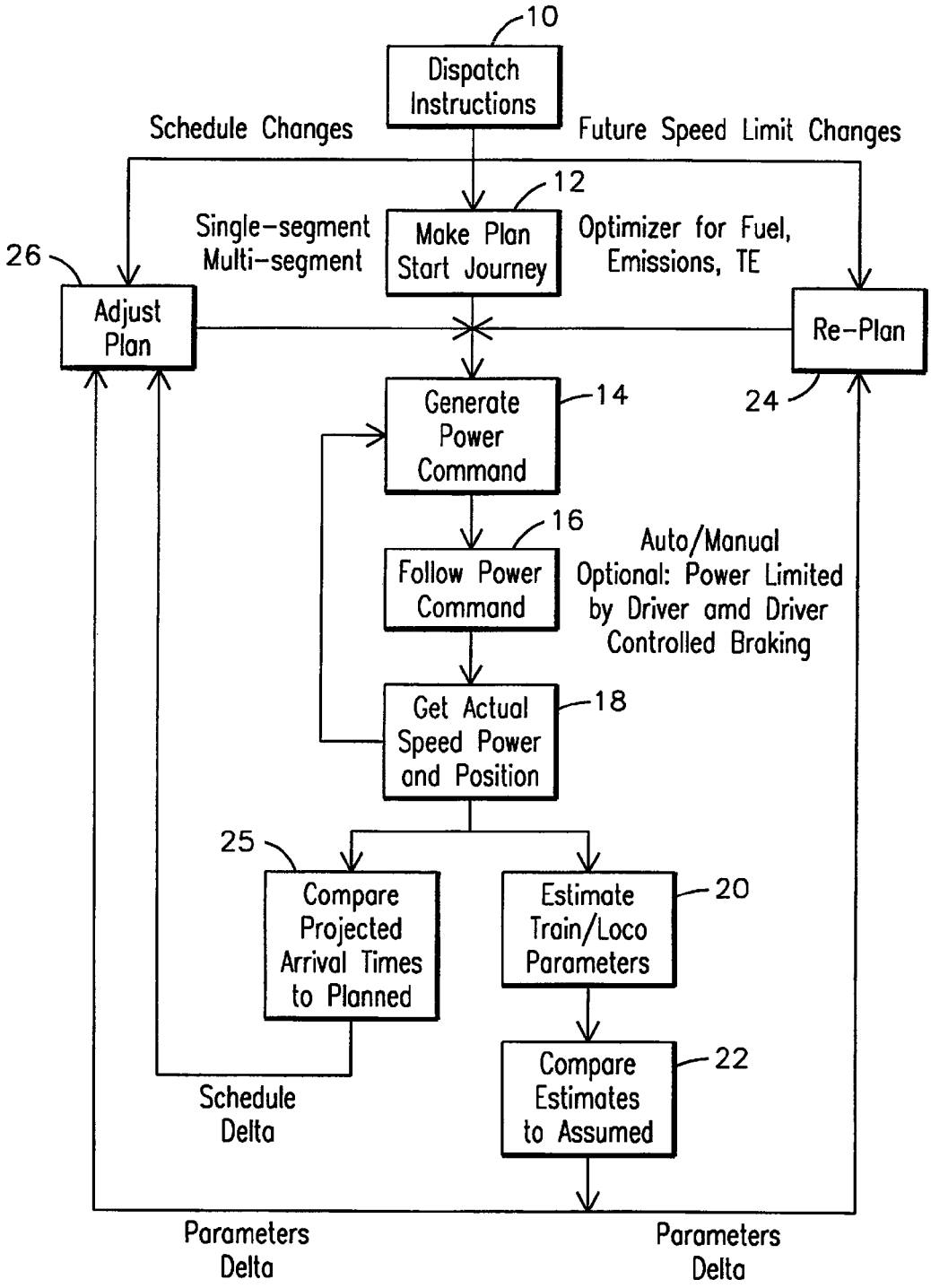
FIG. 1 depicts an exemplary illustration of a flow chart of the present invention.

Reference will now be made in detail to the embodiments consistent with the invention, examples of which are illustrated in the accompanying drawings. Wherever possible, the same reference numerals used throughout the drawings refer to the same or like parts.

Exemplary embodiments of the invention solves the problems in the art by providing a system, method, and computer implemented method, such as a computer software code, for improving overall fuel efficiency of a train through optimized train power makeup. The present invention is also operable when the locomotive consist is in distributed power operations. Persons skilled in the art will recognize that an apparatus, such as a data processing system, including a CPU, memory, I/O, program storage, a connecting bus, and other appropriate components, could be programmed or otherwise designed to facilitate the practice of the method of the invention. Such a system would include appropriate program means for executing the method of the invention.

Also, an article of manufacture, such as a pre-recorded disk or other similar computer program product, for use with a data processing system, could include a storage medium and program means recorded thereon for directing the data processing system to facilitate the practice of the method of the invention. Such apparatus and articles of manufacture also fall within the spirit and scope of the invention.

Broadly speaking, the technical effect is an improvement of fuel efficiency and/or emissions efficiency of a train operating within a multi-section track that is part of an intersecting railroad network. To facilitate an understanding of the exemplary embodiments of the invention, it is described hereinafter with reference to specific implementations thereof. Exemplary embodiments of the invention may be described in the general context of computer-executable instructions, such as program modules, being executed by a computer. Generally, program modules include routines, programs, objects, components, data structures, etc. that perform particular tasks or implement particular abstract data types. For example, the software programs that underlie exemplary embodiments of the invention can be coded in different languages, for use with different platforms. In the description that follows, examples of the invention may be described in the context of a web portal that employs a web browser. It will be appreciated, however, that the principles that underlie exemplary embodiments of the invention can be implemented with other types of computer software technologies as well.

Moreover, those skilled in the art will appreciate that exemplary embodiments of the invention may be practiced with other computer system configurations, including hand-held devices, multiprocessor systems, microprocessor-based or programmable consumer electronics, minicomputers, mainframe computers, and the like. Exemplary embodiments of the invention may also be practiced in distributed computing environments where tasks are performed by remote processing devices that are linked through a communications network. In a distributed computing environment, program modules may be located in both local and remote computer storage media including memory storage devices. These local and remote computing environments may be contained entirely within the locomotive, or adjacent locomotives in consist, or off-board in wayside or central offices where wireless and/or wired communication is used.

Throughout this document the term locomotive consist is used. As used herein, a locomotive consist may be described as having one or more locomotives in succession, connected together so as to provide motoring and/or braking capability. The locomotives are connected together where no train cars are in between the locomotives. The train can have more than one locomotive consists in its composition. Specifically, there can be a lead consist and more than one remote consists, such as midway in the line of cars and another remote consist at the end of the train. Each locomotive consist may have a first locomotive and trail locomotive(s). It is understood that the lead consist can reside anywhere in the overall train make up. More specifically, even though a first locomotive is usually viewed as the lead locomotive, those skilled in the art will readily recognize that the first locomotive in a multi locomotive consist may be physically located in a physically trailing position. Though a locomotive consist is usually viewed as successive locomotives, those skilled in the art will readily recognize that a consist group of locomotives may also be recognized as a consist even when at least a car separates the locomotives, such as when the locomotive consist is configured for distributed power operation, wherein throttle and braking commands are relayed from the lead locomotive to the remote trains by a radio link or physical cable. Towards this end, the term locomotive consist should be not be considered a limiting factor when discussing multiple locomotives within the same train.

Referring now to the drawings, embodiments of the present invention will be described. Exemplary embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

FIG. 1 depicts an exemplary illustration of a flow chart of an exemplary embodiment of the present invention. As illustrated, instructions are input specific to planning a trip either on board or from a remote location, such as a dispatch center 10. Such input information includes, but is not limited to, train position, consist description (such as locomotive models), locomotive power description, performance of locomotive traction transmission, consumption of engine fuel as a function of output power, locomotive or train emissions as a function of power setting speed and load dynamics, cooling characteristics, the intended trip route (effective track grade and curvature as function of milepost or an "effective grade" component to reflect curvature following standard railroad practices), the train represented by car makeup and loading together with effective drag coefficients, trip desired parameters including, but not limited to, start time and location, end location, desired travel time, crew (user and/or operator) identification, crew shift expiration time, and route.

This data may be provided to the locomotive 42 in a number of ways, such as, but not limited to, an operator manually entering this data into the locomotive 42 via an onboard display, characteristics as provided by the manufacturer or operator, inserting a memory device such as a hard card and/or USB drive containing the data into a receptacle aboard the locomotive, and transmitting the information via wireless communication from a central or wayside location 41, such as a track signaling device and/or a wayside device, to the locomotive 42. Locomotive 42 and train 31 load characteristics (e.g., drag) may also change over the route (e.g., with altitude, ambient temperature and condition of the rails and rail-cars), and the plan may be updated to reflect such changes as needed by any of the methods discussed above and/or by real-time autonomous collection of locomotive/train conditions. This includes for example, changes in locomotive or train characteristics detected by monitoring equipment on or off board the locomotive(s) 42.

The track signal system determines the allowable speed of the train. There are many types of track signal systems and the operating rules associated with each of the signals. For example, some signals have a single light (on/off), some signals have a single lens with multiple colors, and some signals have multiple lights and colors. These signals can indicate the track is clear and the train may proceed at max allowable speed. They can also indicate a reduced speed or stop is required. This reduced speed may need to be achieved immediately, or at a certain location (e.g. prior to the next signal or crossing).

The signal status is communicated to the train and/or operator through various means. Some systems have circuits in the track and inductive pick-up coils on the locomotives. Other systems have wireless communication systems and/or wired communication systems. Signal systems can also require the operator to visually inspect the signal and take the appropriate actions.

The signaling system may interface with the on-board signal system and adjust the locomotive speed according to the inputs and the appropriate operating rules. For signal systems that require the operator to visually inspect the signal status, the operator screen will present the appropriate signal options for the operator to enter based on the train's location. The type of signal systems and operating rules, as a function of location, may be stored in an onboard database 63.

Based on the specification data input into the exemplary embodiment of the present invention, an optimal plan which minimizes fuel use and/or emissions produced subject to speed limit constraints along the route with desired start and end times is computed to produce a trip profile 12. The profile contains the optimal speed and power (notch) settings the train is to follow, expressed as a function of distance and/or time, and such train operating limits, including but not limited to, the maximum notch power and brake settings, and speed limits as a function of location, and the expected fuel used and emissions generated. In an exemplary embodiment, the value for the notch setting is selected to obtain throttle change decisions about once every 10 to 30 seconds. Those skilled in the art will readily recognize that the throttle change decisions may occur at a longer or shorter duration, if needed and/or desired to follow an optimal speed profile. In a broader sense, it should be evident to ones skilled in the art the profiles provide power settings for the train, either at the train level, consist level and/or individual train level. Power comprises braking power, motoring power, and airbrake power. In another preferred embodiment, instead of operating at the traditional discrete notch power settings, the exemplary embodiment of the present invention is able to select a continuous power setting determined as optimal for the profile selected. Thus, for example, if an optimal profile specifies a notch setting of 6.8, instead of operating at notch setting 7, the locomotive 42 can operate at 6.8. Allowing such intermediate power settings may bring additional efficiency benefits as described below.

The procedure used to compute the optimal profile can be any number of methods for computing a power sequence that drives the train 31 to minimize fuel and/or emissions subject to locomotive operating and schedule constraints, as summarized below. In some cases the required optimal profile may be close enough to one previously determined, owing to the similarity of the train configuration, route and environmental conditions. In these cases it may be sufficient to look up the driving trajectory within a database 63 and attempt to follow it. When no previously computed plan is suitable, methods to compute a new one include, but are not limited to, direct calculation of the optimal profile using differential equation models which approximate the train physics of motion. The setup involves selection of a quantitative objective function, commonly a weighted sum (integral) of model variables that correspond to rate of fuel consumption and emissions generation plus a term to penalize excessive throttle variation.

An optimal control formulation is set up to minimize the quantitative objective function subject to constraints including but not limited to, speed limits and minimum and maximum power (throttle) settings. Depending on planning objectives at any time, the problem may be setup flexibly to minimize fuel subject to constraints on emissions and speed limits, or to minimize emissions, subject to constraints on fuel use and arrival time. It is also possible to setup, for example, a goal to minimize the total travel time without constraints on total emissions or fuel use where such relaxation of constraints would be permitted or required for the mission.

Throughout the document exemplary equations and objective functions are presented for minimizing locomotive fuel consumption. These equations and functions are for illustration only as other equations and objective functions can be employed to optimize fuel consumption or to optimize other locomotive/train operating parameters.

Mathematically, the problem to be solved may be stated more precisely. The basic physics are expressed by:

$$\frac{dx}{dt} = v;\ x(0) = 0.0;\ x(T_f) = D$$

$$\frac{dv}{dt} = T_e(u, v) - G_a(x) - R(v);\ v(0) = 0.0;\ v(T_f) = 0.0$$

Where x is the position of the train, v its velocity and t is time (in miles, miles per hour and minutes or hours as appropriate) and u is the notch (throttle) command input. Further, D denotes the distance to be traveled, $T_f$ the desired arrival time at distance D along the track, $T_e$ is the tractive effort produced by the locomotive consist, $G_a$ is the gravitational drag which depends on the train length, train makeup and terrain on which the train is located, R is the net speed dependent drag of the locomotive consist and train combination. The initial and final speeds can also be specified, but without loss of generality are taken to be zero here (train stopped at beginning and end). Finally, the model is readily modified to include other important dynamics such the lag between a change in throttle, u, and the resulting tractive effort or braking. Using this model, an optimal control formulation is set up to minimize the quantitative objective function subject to constraints including but not limited to, speed limits and minimum and maximum power (throttle) settings. Depending on planning objectives at any time, the problem may be setup flexibly to minimize fuel subject to constraints on emissions and speed limits, or to minimize emissions, subject to constraints on fuel use and arrival time.

It is also possible to setup, for example, a goal to minimize the total travel time without constraints on total emissions or fuel use where such relaxation of constraints would be permitted or required for the mission. All these performance measures can be expressed as a linear combination of any of the following:

1.

$$\min_{u(t)} \int_0^{T_f} F(u(t))dt$$

—Minimize total fuel consumption

2.

$$\min_{u(t)} T_f$$

—Minimize Travel Time

3.

$$\min_{u_i} \sum_{i=2}^{n_d} (u_i - u_{i-1})^2$$

—Minimize notch jockeying (piecewise constant input)

4.

$$\min_{u(t)} \int_0^{T_f} (du/dt)^2 dt$$

—Minimize notch jockeying (continuous input)

5. Replace the fuel term F in (1) with a term corresponding to emissions production. For example for emissions $$\min_{u(t)} \int_0^{T_f} E(u(t))dt$$

—Minimize total emissions consumption. In this equation E is the quantity of emissions in gram per horse power-hour (gm/hphr) for each of the notches (or power settings). In addition a minimization could be done based on a weighted total of fuel and emissions. A commonly used and representative objective function is thus:

$$\min_{u(t)} \alpha_1 \int_0^{T_f} F(u(t))dt + \alpha_3 T_f + \alpha_2 \int_0^{T_f} (du/dt)^2 dt \qquad \text{(OP)}$$

The coefficients of the linear combination depend on the importance (weight) given to each of the terms. Note that in equation (OP), u(t) is the optimizing variable that is the continuous notch position. If discrete notch is required, e.g. for older locomotives, the solution to equation (OP) is discretized, which may result in lower fuel savings. Finding a minimum time solution ($\alpha_1$ set to zero and $\alpha_2$ set to zero or a relatively small value) is used to find a lower bound for the achievable travel time ($T_f = T_{fmin}$) In this case, both u(t) and $T_f$ are optimizing variables. The preferred embodiment solves the equation (OP) for various values of $T_f$ with $T_f > T_{fmin}$ with $\alpha_3$ set to zero. In this latter case, $T_f$ is treated as a constraint.

For those familiar with solutions to such optimal problems, it may be necessary to adjoin constraints, e.g. the speed limits along the path:

$$0 \le v \le SL(x)$$

Or when using minimum time as the objective, that an end point constraint must hold, e.g. total fuel consumed must be less than what is in the tank, e.g. via:

$$0 < \int_0^{T_f} F(u(t))dt \le W_F$$

Where $W_F$ is the fuel remaining in the tank at $T_f$. Those skilled in the art will readily recognize that equation (OP) can be in other forms as well and that what is presented above is an exemplary equation for use in the exemplary embodiment of the present invention.

The optimization function may include fuel efficiency or emissions, or a combination of fuel efficiency and emissions.

Note that as disclosed below, the emissions could be of different types and could be weighted also.

Reference to emissions in the context of the exemplary embodiment of the present invention is actually directed towards cumulative emissions produced in the form of oxides of nitrogen ($NO_x$) emissions, hydrocarbon emissions (HC), a carbon monoxide (CO) emissions, and/or a particulate matter (PM) emissions. An emission requirement may set a maximum value of an oxide of $NO_x$ emissions, HC emissions, CO emissions, and/or PM emissions. Other emission limits may include a maximum value of an electromagnetic emission, such as a limit on radio frequency (RF) power output, measured in watts, for respective frequencies emitted by the locomotive. Yet another form of emission is the noise produced by the locomotive, typically measured in decibels (dB). An emission requirement may be variable based on a time of day, a time of year, and/or atmospheric conditions such as weather or pollutant level in the atmosphere. It is known that emissions regulations may vary geographically across a railroad system. For instance, an operating area such as a city or state may have specified emissions objectives, and an adjacent operating area may have different emission objectives, for example a lower amount of allowed emissions or a higher fee charged for a given level of emissions. Accordingly, an emission profile for a certain geographic area may be tailored to include maximum emission values for each of the regulated emission including in the profile to meet a predetermined emission objective required for that area. Typically for a locomotive, these emission parameters are determined by, but not limited to, the power (Notch), ambient conditions, engine control method etc.

By design, every locomotive must be compliant to agency (such as but not limited to the Environmental Protection Agency (EPA), International Union of Railroads (UIC), etc.) and/or regulatory standards for brake-specific emissions, and thus when emissions are optimized in the exemplary embodiment of the present invention this would be mission total emissions on which there is no specification today. At all times, operations would be compliant with federal EPA, UIC, etc., mandates. If a key objective during a trip mission is to reduce emissions, the optimal control formulation, equation (OP), would be amended to consider this trip objective. A key flexibility in the optimization setup is that any or all of the trip objectives can vary by geographic region or mission. For example, for a high priority train, minimum time may be the only objective on one route because it is high priority traffic. In another example emission output could vary from state to state along the planned train route.

To solve the resulting optimization problem, in an exemplary embodiment the present invention transcribes a dynamic optimal control problem in the time domain to an equivalent static mathematical programming problem with N decision variables, where the number 'N' depends on the frequency at which throttle and braking adjustments are made and the duration of the trip. For typical problems, this N can be in the thousands. For example in an exemplary embodiment, suppose a train is traveling a 172-mile stretch of track in the southwest United States. Utilizing the exemplary embodiment of the present invention, an exemplary 7.6% saving in fuel used may be realized when comparing a trip determined and followed using the exemplary embodiment of the present invention versus an actual driver throttle/speed history where the trip was determined by an operator. The improved savings is realized because the optimization realized by using the exemplary embodiment of the present invention produces a driving strategy with both less drag loss and little or no braking loss compared to the trip plan of the operator.

Figure 2:
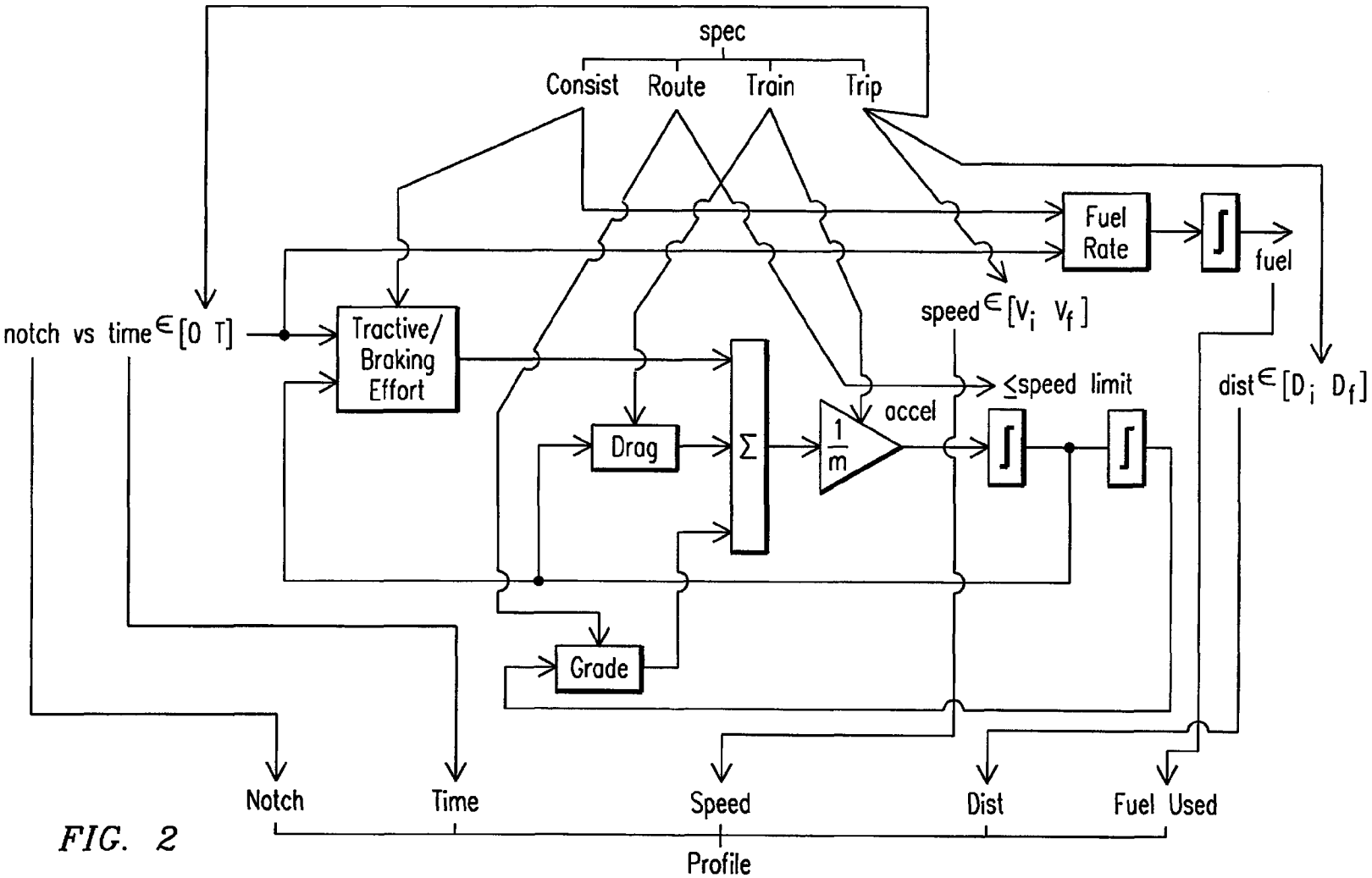
FIG. 2 depicts a simplified model of the train that may be employed.

To make the optimization described above computationally tractable, a simplified model of the train may be employed, such as illustrated in FIG. 2 and the equations discussed above. A key refinement to the optimal profile is produced by driving a more detailed model with the optimal power sequence generated, to test if other thermal, electrical and mechanical constraints are violated, leading to a modified profile with speed versus distance that is closest to a run that can be achieved without harming locomotive or train equipment, i.e. satisfying additional implied constraints such thermal and electrical limits on the locomotive and inter-car forces in the train.

Referring back to FIG. 1, once the trip is started 12, power commands are generated 14 to put the plan in motion. Depending on the operational set-up of the exemplary embodiment of the present invention, one command is for the locomotive to follow the optimized power command 16 so as to achieve the optimal speed. The exemplary embodiment of the present invention obtains actual speed and power information from the locomotive consist of the train 18. Owing to the inevitable approximations in the models used for the optimization, a closed-loop calculation of corrections to optimized power is obtained to track the desired optimal speed. Such corrections of train operating limits can be made automatically or by the operator, who always has ultimate control of the train.

In some cases, the model used in the optimization may differ significantly from the actual train. This can occur for many reasons, including but not limited to, extra cargo pick-ups or setouts, locomotives that fail in route, and errors in the initial database 63 or data entry by the operator. For these reasons a monitoring system is in place that uses real-time train data to estimate locomotive and/or train parameters in real time 20. The estimated parameters are then compared to the assumed parameters used when the trip was initially created 22. Based on any differences in the assumed and estimated values, the trip may be re-planned 24, should large enough savings accrue from a new plan.

Other reasons a trip may be re-planned include directives from a remote location, such as dispatch and/or the operator requesting a change in objectives to be consistent with more global movement planning objectives. More global movement planning objectives may include, but are not limited to, other train schedules, allowing exhaust to dissipate from a tunnel, maintenance operations, etc. Another reason may be due to an onboard failure of a component. Strategies for re-planning may be grouped into incremental and major adjustments depending on the severity of the disruption, as discussed in more detail below. In general, a "new" plan must be derived from a solution to the optimization problem equation (OP) described above, but frequently faster approximate solutions can be found, as described herein.

Figure 4:
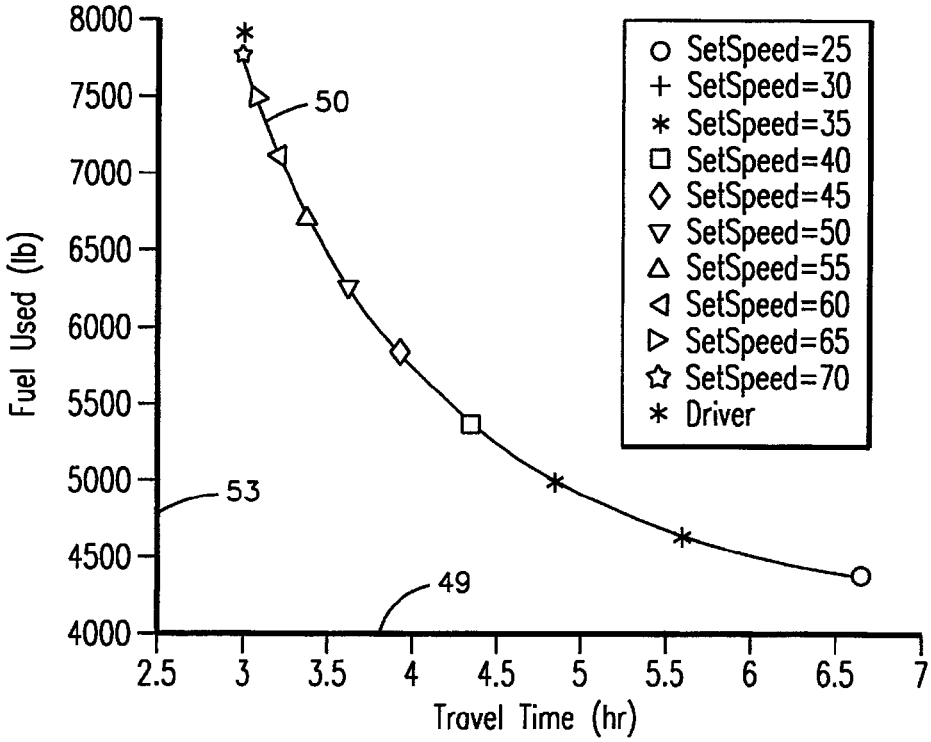
FIG. 4 depicts an exemplary embodiment of a fuel-use/travel time curve.

In operation, the locomotive 42 will continuously monitor system efficiency and continuously update the trip plan based on the actual efficiency measured, whenever such an update would improve trip performance. Re-planning computations may be carried out entirely within the locomotive(s) or fully or partially moved to a remote location, such as dispatch or wayside processing facilities where wireless technology is used to communicate the plans to the locomotive 42. The exemplary embodiment of the present invention may also generate efficiency trends that can be used to develop locomotive fleet data regarding efficiency transfer functions. The fleet-wide data may be used when determining the initial trip plan, and may be used for network-wide optimization tradeoff when considering locations of a plurality of trains. For example, the travel-time fuel use tradeoff curve as illustrated in FIG. 4 reflects a capability of a train on a particular route at a current time, updated from ensemble averages collected for many similar trains on the same route. Thus, a central dispatch facility collecting curves like FIG. 4 from many locomotives could use that information to better coordinate overall train movements to achieve a system-wide advantage in fuel use or throughput. Therefore it should be apparent to ones skilled in the art that real time data is used in place of previously calculated functions, wherein locomotive and locomotive consist actions are controlled based on actual available data. Though fuel used in utilized, those skilled in the art will recognize that a similar graph may be used when emissions are sought to be optimized where the comparison is made between emissions and travel time. Other comparisons may include, but are not limited to emissions versus speed, and emissions versus speed versus fuel efficiency.

Many events in daily operations can lead to a need to generate or modify a currently executing plan, where it desired to keep the same trip objectives, for when a train is not on schedule for planned meet or pass with another train and it needs to make up time. Using the actual speed, power and location of the locomotive, a comparison is made between a planned arrival time and the currently estimated (predicted) arrival time 25. Based on a difference in the times, as well as the difference in parameters (detected or changed by dispatch or the operator), the plan is adjusted 26. This adjustment may be made automatically following a railroad company's desire for how such departures from plan should be handled or manually propose alternatives for the on-board operator and dispatcher to jointly decide the best way to get back on plan. Whenever a plan is updated but where the original objectives, such as but not limited to arrival time remain the same, additional changes may be factored in concurrently, e.g. new future speed limit changes, which could affect the feasibility of ever recovering the original plan. In such instances if the original trip plan cannot be maintained, or in other words the train is unable to meet the original trip plan objectives, as discussed herein other trip plan(s) may be presented to the operator and/or remote facility, or dispatch.

A re-plan may also be made when it is desired to change the original objectives. Such re-planning can be done at either fixed preplanned times, manually at the discretion of the operator or dispatcher, or autonomously when predefined limits, such a train operating limits, are exceeded. For example, if the current plan execution is running late by more than a specified threshold, such as thirty minutes, the exemplary embodiment of the present invention can re-plan the trip to accommodate the delay at expense of increased fuel as described above or to alert the operator and dispatcher how much of the time can be made up at all (i.e. what minimum time to go or the maximum fuel that can be saved within a time constraint). Other triggers for re-plan can also be envisioned based on fuel consumed or the health of the power consist, including but not limited time of arrival, loss of horsepower due to equipment failure and/or equipment temporary malfunction (such as operating too hot or too cold), and/or detection of gross setup errors, such in the assumed train load, optimization of total emissions as occurred along the route and projected to the final destination. That is, if the change reflects impairment in the locomotive performance for the current trip, these may be factored into the models and/or equations used in the optimization.

Changes in plan objectives can also arise from a need to coordinate events where the plan for one train compromises the ability of another train to meet objectives and arbitration at a different level, e.g. the dispatch office is required. For example, the coordination of meets and passes may be further optimized through train-to-train communications. Thus, as an example, if a train knows that it is behind in reaching a location for a meet and/or pass, communications from the other train can notify the late train (and/or dispatch). The operator can then enter information pertaining to being late into the exemplary embodiment of the present invention wherein the exemplary embodiment will recalculate the train's trip plan. The exemplary embodiment of the present invention can also be used at a high level, or network-level, to allow a dispatch to determine which train should slow down or speed up should a scheduled meet and/or pass time constraint may not be met. As discussed herein, this is accomplished by trains transmitting data to the dispatch to prioritize how each train should change its planning objective. A choice could depend either from schedule or fuel saving benefits, depending on the situation.

For any of the manually or automatically initiated re-plans, exemplary embodiments of the present invention may present more than one trip plan to the operator. In an exemplary embodiment the present invention will present different profiles to the operator, allowing the operator to select the arrival time and understand the corresponding fuel and/or emission impact. Such information can also be provided to the dispatch for similar consideration, either as a simple list of alternatives or as a plurality of tradeoff curves such as illustrated in FIG. 4.

The exemplary embodiment of the present invention has the ability of learning and adapting to key changes in the train and power consist which can be incorporated either in the current plan and/or for future plans. For example, one of the triggers discussed above is loss of horsepower. When building up horsepower over time, either after a loss of horsepower or when beginning a trip, transition logic is utilized to determine when desired horsepower is achieved. This information can be saved in the locomotive database 61 for use in optimizing either future trips or the current trip should loss of horsepower occur again.

Figure 3:
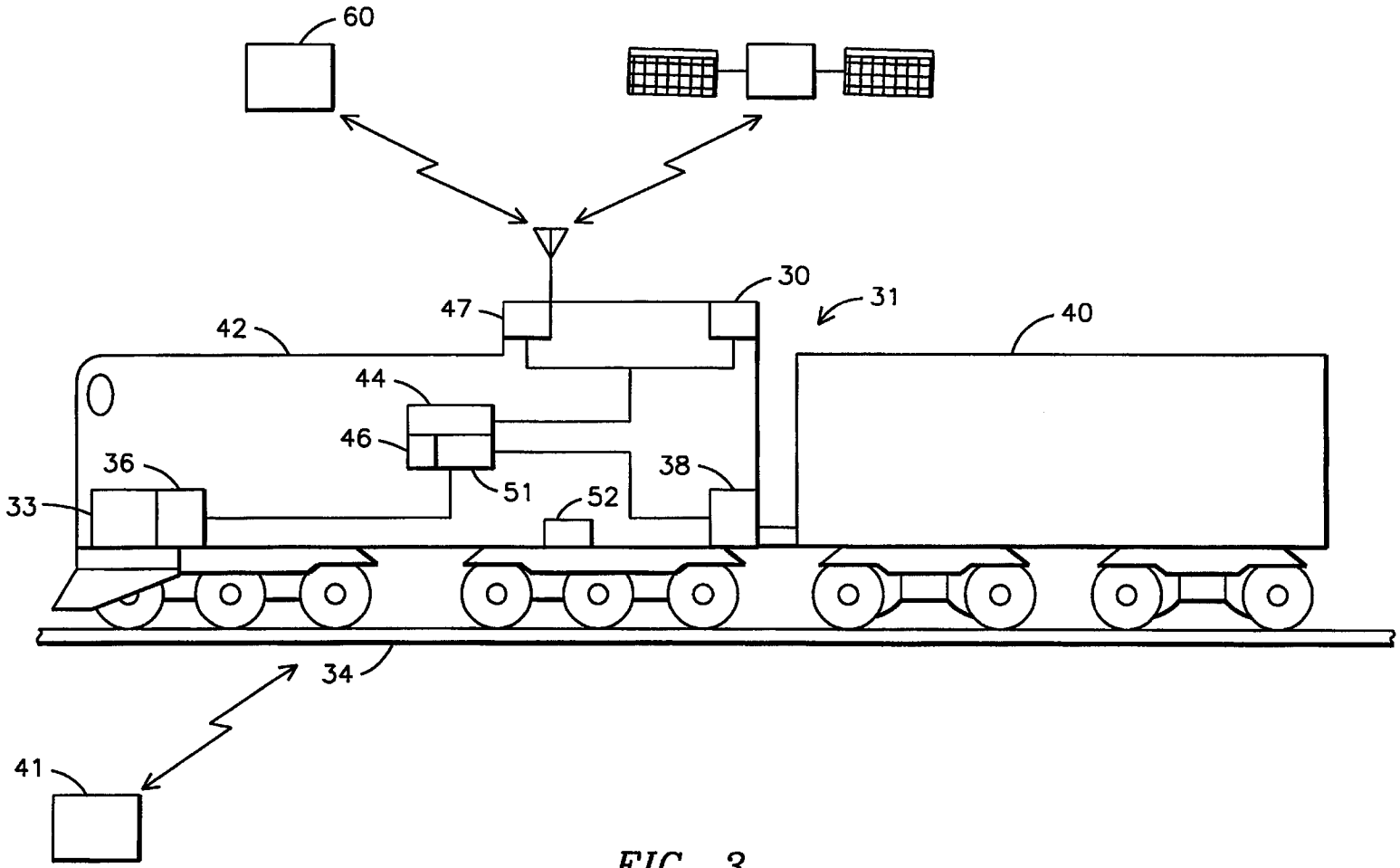
FIG. 3 depicts an exemplary embodiment of elements of the present invention.

FIG. 3 depicts an exemplary embodiment of elements of that may part of an exemplary system. A locator element 30 to determine a location of the train 31 is provided. The locator element 30 can be a GPS sensor, or a system of sensors, that determine a location of the train 31. Examples of such other systems may include, but are not limited to, wayside devices, such as radio frequency automatic equipment identification (RF AEI) Tags, dispatch, and/or video determination. Another system may include the tachometer(s) aboard a locomotive and distance calculations from a reference point. As discussed previously, a wireless communication system 47 may also be provided to allow for communications between trains and/or with a remote location, such as dispatch. Information about travel locations may also be transferred from other trains.

A track characterization element 33 to provide information about a track, principally grade and elevation and curvature information, is also provided. Optionally track restrictions such as track load can be included. These restrictions can be permanent or temporary. The track characterization element 33 may include an on-board track integrity database 36. Sensors 38 are used to measure a tractive effort 40 being hauled by the locomotive consist 42, throttle setting of the locomotive consist 42, locomotive consist 42 configuration information, speed of the locomotive consist 42, individual locomotive configuration, individual locomotive capability, etc. In an exemplary embodiment the locomotive consist 42 configuration information may be loaded without the use of a sensor 38, but is input by other approaches as discussed above. Furthermore, the health of the locomotives in the consist may also be considered. For example, if one locomotive in the consist is unable to operate above power notch level 5, this information is used when optimizing the trip plan.

Information from the locator element may also be used to determine an appropriate arrival time of the train 31. For example, if there is a train 31 moving along a track 34 towards a destination and no train is following behind it, and the train has no fixed arrival deadline to adhere to, the locator element, including but not limited to radio frequency automatic equipment identification (RF AEI) Tags, dispatch, and/or video determination, may be used to gage the exact location of the train 31. Furthermore, inputs from these signaling systems may be used to adjust the train speed. Using the on-board track database, discussed below, and the locator element, such as GPS, the exemplary embodiment of the present invention can adjust the operator interface to reflect the signaling system state at the given locomotive location. In a situation where signal states would indicate restrictive speeds ahead, the planner may elect to slow the train to conserve fuel consumption. Similarly, the planner may elect to slow the train to conserve emission rates.

Information from the locator element 30 may also be used to change planning objectives as a function of distance to destination. For example, owing to inevitable uncertainties about congestion along the route, "faster" time objectives on the early part of a route may be employed as hedge against delays that statistically occur later. If it happens on a particular trip that delays do not occur, the objectives on a latter part of the journey can be modified to exploit the built-in slack time that was banked earlier, and thereby recover some fuel efficiency. A similar strategy could be invoked with respect to emissions restrictive objectives, e.g. approaching an urban area.

As an example of the hedging strategy, if a trip is planned from New York to Chicago, the system may have an option to operate the train slower at either the beginning of the trip or at the middle of the trip or at the end of the trip. The exemplary embodiment of the present invention would optimize the trip plan to allow for slower operation at the end of the trip since unknown constraints, such as but not limited to weather conditions, track maintenance, etc., may develop and become known during the trip. As another consideration, if traditionally congested areas are known, the plan is developed with an option to have more flexibility around these traditionally congested regions. Therefore, the exemplary embodiment of the present invention may also consider weighting/penalty as a function of time/distance into the future and/or based on known/past experience. Those skilled in the art will readily recognize that such planning and re-planning to take into consideration weather conditions, track conditions, other trains on the track, etc., may be taking into consideration at any time during the trip wherein the trip plan is adjust accordingly.

FIG. 3 further discloses other elements that may be part of the exemplary embodiment of the present invention. A processor 44 is provided that is operable to receive information from the locator element 30, track characterizing element 33, and sensors 38. An algorithm 46 operates within the processor 44. The algorithm 46 is used to compute an optimized trip plan based on parameters involving the locomotive 42, train 31, track 34, and objectives of the mission as described above. In an exemplary embodiment, the trip plan is established based on models for train behavior as the train 31 moves along the track 34 as a solution of non-linear differential equations derived from physics with simplifying assumptions that are provided in the algorithm. The algorithm 46 has access to the information from the locator element 30, track characterizing element 33 and/or sensors 38 to create a trip plan minimizing fuel consumption of a locomotive consist 42, minimizing emissions of a locomotive consist 42, establishing a desired trip time, and/or ensuring proper crew operating time aboard the locomotive consist 42. In an exemplary embodiment, a driver, or controller element, 51 is also provided. As discussed herein the controller element 51 is used for controlling the train as it follows the trip plan. In an exemplary embodiment discussed further herein, the controller element 51 makes train operating decisions autonomously. In another exemplary embodiment the operator may be involved with directing the train to follow the trip plan.

A requirement of the exemplary embodiment of the present invention is the ability to initially create and quickly modify on the fly any plan that is being executed. This includes creating the initial plan when a long distance is involved, owing to the complexity of the plan optimization algorithm. When a total length of a trip profile exceeds a given distance, an algorithm 46 may be used to segment the mission wherein the mission may be divided by waypoints. Though only a single algorithm 46 is discussed, those skilled in the art will readily recognize that more than one algorithm may be used where the algorithms may be connected together. The waypoint may include natural locations where the train 31 stops, such as, but not limited to, sidings where a meet with opposing traffic, or pass with a train behind the current train is scheduled to occur on single-track rail, or at yard sidings or industry where cars are to be picked up and set out, and locations of planned work. At such waypoints, the train 31 may be required to be at the location at a scheduled time and be stopped or moving with speed in a specified range. The time duration from arrival to departure at waypoints is called dwell time.

In an exemplary embodiment, the present invention is able to break down a longer trip into smaller segments in a special systematic way. Each segment can be somewhat arbitrary in length, but is typically picked at a natural location such as a stop or significant speed restriction, or at key mileposts that define junctions with other routes. Given a partition, or segment, selected in this way, a driving profile is created for each segment of track as a function of travel time taken as an independent variable, such as shown in FIG. 4. The fuel used and/emissions/travel-time tradeoff associated with each segment can be computed prior to the train 31 reaching that segment of track. A total trip plan can be created from the driving profiles created for each segment. The exemplary embodiment of the invention distributes travel time amongst all the segments of the trip in an optimal way so that the total trip time required is satisfied and total fuel consumed and/or emissions over all the segments is as small as possible. An exemplary 3 segment trip is disclosed in FIG. 6 and discussed below. Those skilled in the art will recognize however, through segments are discussed, the trip plan may comprise a single segment representing the complete trip.

FIG. 4 depicts an exemplary embodiment of a fuel-use/travel time curve. In a similar embodiment, those skilled in the art will readily recognize that an emission/travel time curve may be considered. As mentioned previously, with respect to the fuel-use/travel time curve such a curve 50 is created when calculating an optimal trip profile for various travel times for each segment. That is, for a given travel time 49, fuel used 53 is the result of a detailed driving profile computed as described above. Once travel times for each segment are allocated, a power/speed plan is determined for each segment from the previously computed solutions. If there are any waypoint constraints on speed between the segments, such as, but not limited to, a change in a speed limit, they are matched up during creation of the optimal trip profile. If speed restrictions change in only a single segment, the fuel use/travel-time curve 50 has to be re-computed for only the segment changed. This reduces time for having to re-calculate more parts, or segments, of the trip. If the locomotive consist or train changes significantly along the route, e.g. from loss of a locomotive or pickup or set-out of cars, then driving profiles for all subsequent segments must be recomputed creating new instances of the curve 50. These new curves 50 would then be used along with new schedule objectives to plan the remaining trip.

Once a trip plan is created as discussed above, a trajectory of at least a comparison of speed and power versus distance, speed, emission and power versus distance, emissions versus speed, emissions versus power, etc., is used to reach a destination with minimum fuel and/or emissions at the required trip time. Though certain comparisons are identified above, those skilled in the art will readily recognize other comparisons of these parameters as well as others may be utilized. The intent of the comparisons is to achieve a combined performance optimum based on a combination of any of the parameters disclosed, as selected by an operator or user. There are several ways in which to execute the trip plan. As provided below in more detail, in an exemplary embodiment, when in a coaching mode information is displayed to the operator for the operator to follow to achieve the required power and speed determined according to the optimal trip plan. In this mode, the operating information is suggested operating conditions that the operator should use. In another exemplary embodiment, acceleration and maintaining a constant speed are performed. However, when the train 31 must be slowed, the operator is responsible for applying a braking system 52. In another exemplary embodiment of the present invention commands for powering and braking are provided as required to follow the desired speed-distance path. Though disclosed with respect to power and speed, the other parameters disclosed above may be the parameters utilized when in the coaching mode.

Feedback control strategies are used to provide corrections to the power control sequence in the profile to correct for such events as, but not limited to, train load variations caused by fluctuating head winds and/or tail winds. Another such error may be caused by an error in train parameters, such as, but not limited to, train mass and/or drag, when compared to assumptions in the optimized trip plan. A third type of error may occur with information contained in the track database 36. Another possible error may involve un-modeled performance differences due to the locomotive engine, traction motor thermal deration and/or other factors. Feedback control strategies compare the actual speed as a function of position to the speed in the desired optimal profile. Based on this difference, a correction to the optimal power profile is added to drive the actual velocity toward the optimal profile. To assure stable regulation, a compensation algorithm may be provided which filters the feedback speeds into power corrections to assure closed-performance stability is assured. Compensation may include standard dynamic compensation as used by those skilled in the art of control system design to meet performance objectives.

Exemplary embodiments of the present invention allow the simplest and therefore fastest means to accommodate changes in trip objectives, which is the rule, rather than the exception in railroad operations. In an exemplary embodiment to determine the fuel-optimal trip from point A to point B where there are stops along the way, and for updating the trip for the remainder of the trip once the trip has begun, a sub-optimal decomposition method is usable for finding an optimal trip profile. Using modeling methods the computation method can find the trip plan with specified travel time and initial and final speeds, so as to satisfy all the speed limits and locomotive capability constraints when there are stops. Though the following discussion is directed towards optimizing fuel use, it can also be applied to optimize other factors, such as, but not limited to, emissions, schedule, crew comfort, and load impact. The method may be used at the outset in developing a trip plan, and more importantly to adapting to changes in objectives after initiating a trip. Furthermore, as also disclosed above, balancing between two or more of these factors (or parameters) may also be utilized to optimize a specific factor (or parameter). For example, in another embodiment travel time verses emissions may be the basis of developing the trip plan.

Figure 5:
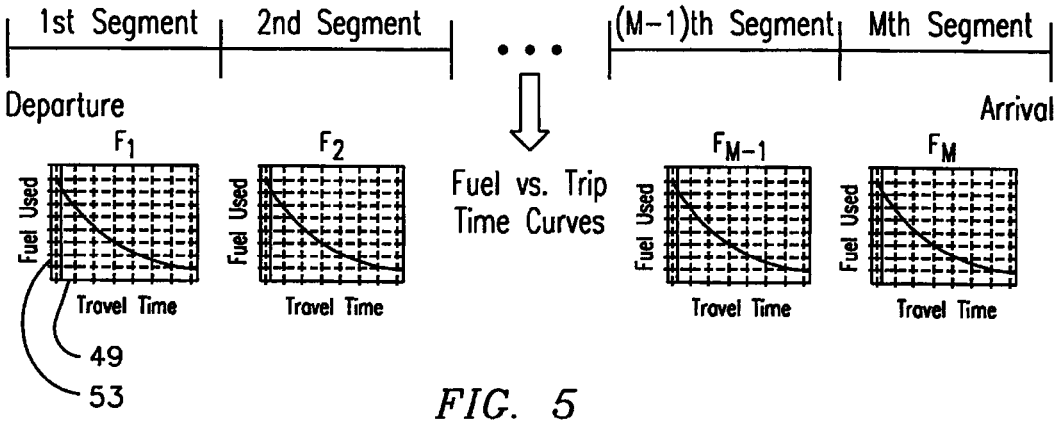
FIG. 5 depicts an exemplary embodiment of segmentation decomposition for trip planning.
Figure 6:
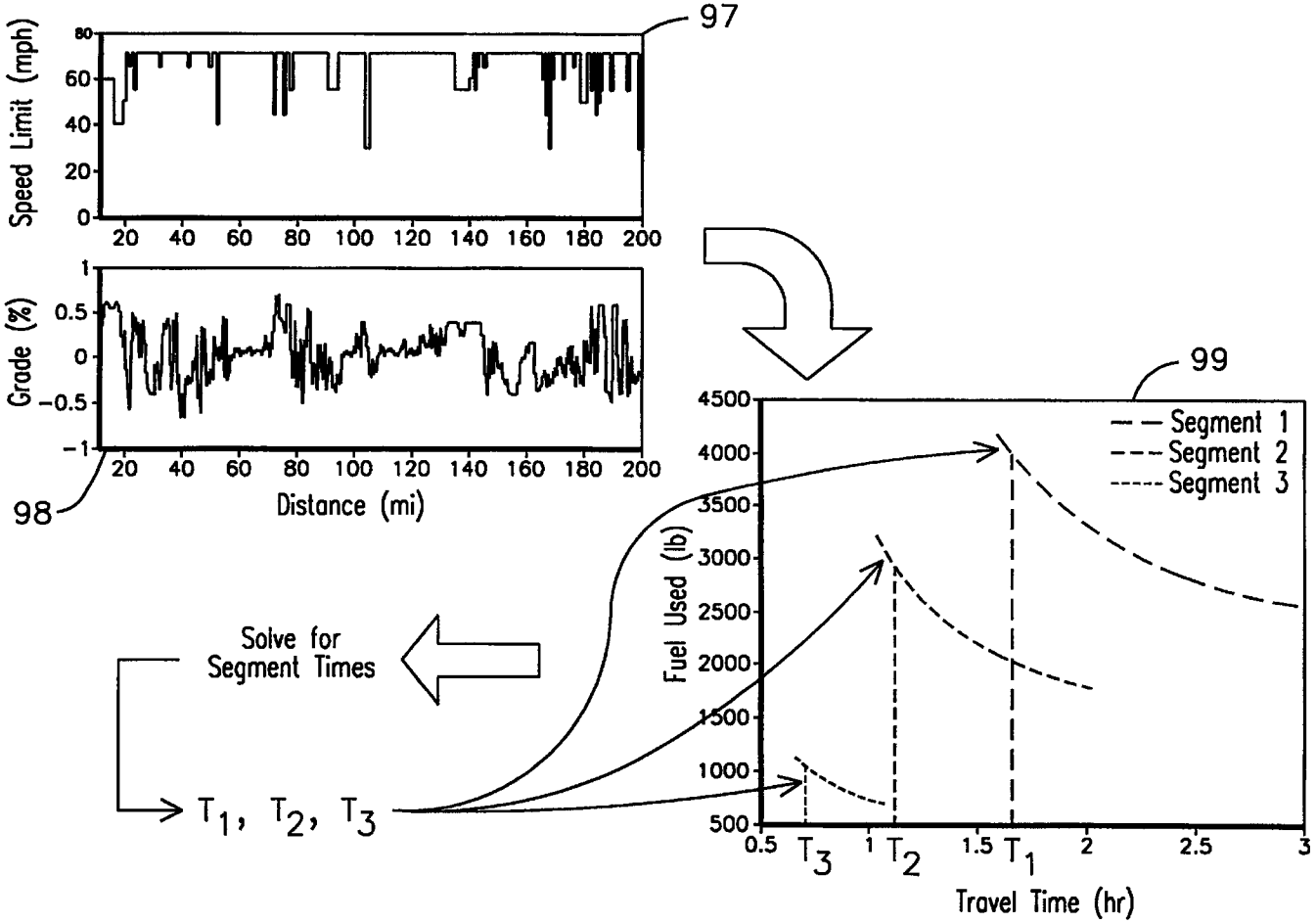
FIG. 6 depicts an exemplary embodiment of a segmentation example.

As discussed herein, exemplary embodiments of the present invention may employ a setup as illustrated in the exemplary flow chart depicted in FIG. 5, and as an exemplary 3-segment example depicted in detail in FIG. 6. As illustrated, the trip may be broken into two or more segments, T1, T2, and T3. Though as discussed herein, it is possible to consider the trip as a single segment. As further discussed herein, the segment boundaries may not result in equal segments. Instead the segments may be based on natural or mission specific boundaries. Optimal trip plans are pre-computed for each segment. If fuel use versus trip time is the trip object to be met, fuel versus trip time curves are built for each segment. As discussed herein, the curves may be based on other factors (parameters) as disclosed above, wherein the factors are objectives to be met with a trip plan. One such factor may be emissions where emission versus speed may be consider and/or emissions versus speed versus fuel efficiency may be considered. When trip time is the parameter being determined, trip time for each segment is computed while satisfying the overall trip time constraints. FIG. 6 illustrates speed limits for an exemplary 3 segment 200 mile trip 97. Further illustrated are grade changes over the 200 mile trip 98. A combined chart 99 illustrating curves for each segment of the trip of fuel used over the travel time is also shown.

Using the optimal control setup described previously, the present computation method can find the trip plan with specified travel time and initial and final speeds, so as to satisfy all the speed limits and locomotive capability constraints when there are stops. Though the following detailed discussion is directed towards optimizing fuel use, it can also be applied to optimize other factors as discussed herein, such as, but not limited to, emissions. A key flexibility is to accommodate desired dwell time at stops and to consider constraints on earliest arrival and departure at a location as may be required, for example, in single-track operations where the time to be in or get by a siding is critical.

Exemplary embodiments of the present invention find a fuel-optimal trip from distance $D_0$ to $D_M$, traveled in time T, with M−1 intermediate stops at $D_1, \ldots, D_{M-1}$, and with the arrival and departure times at these stops constrained by:

$$t_{min}(i) \le t_{arr}(D_i) \le t_{max}(i) - \Delta t_i$$

$$t_{arr}(D_i) + \Delta t_i \le t_{dep}(D_i) \le t_{max}(i) \quad i = 1, \ldots, M-1$$

where $t_{arr}(D_i)$, $t_{dep}(D_i)$, and $\Delta t_i$ are the arrival, departure, and minimum stop time at the $i^{th}$ stop, respectively. Assuming that fuel-optimality implies minimizing stop time, therefore $t_{dep}(D_i) = t_{arr}(D_i) + \Delta t_i$ which eliminates the second inequality above. Suppose for each i=1, . . . , M, the fuel-optimal trip from $D_{j-1}$, to $D_j$ for travel time t, $T_{min}(i) \le t \le T_{max}(i)$, is known. Let $F_i(t)$ be the fuel-use corresponding to this trip. If the travel time from $D_{j-1}$ to $D_j$ is denoted $T_j$, then the arrival time at $D_i$ is given by:

$$t_{arr}(D_i) = \sum_{j=1}^{i} (T_j + \Delta t_{j-1})$$

where $\Delta t_0$ is defined to be zero. The fuel-optimal trip from $D_0$ to $D_M$ for travel time T is then obtained by finding $T_j$, i=1, . . . , M, which minimize $$\sum_{i=1}^{M} F_i(T_i) T_{min}(i) \le T_i \le T_{max}(i)$$

subject to $$t_{min}(i) \le \sum_{j=1}^{i} (T_j + \Delta t_{j-1}) \le t_{max}(i) - \Delta t_i$$

$$i = 1, \ldots, M-1$$

$$\sum_{j=1}^{M} (T_j + \Delta t_{j-1}) = T$$

Once a trip is underway, the issue is re-determining the fuel-optimal solution for the remainder of a trip (originally from $D_0$ to $D_M$ in time T) as the trip is traveled, but where disturbances preclude following the fuel-optimal solution. Let the current distance and speed be x and v, respectively, where $D_{i-1}<x\le D_i$. Also, let the current time since the beginning of the trip be $t_{act}$. Then the fuel-optimal solution for the remainder of the trip from x to $D_M$, which retains the original arrival time at $D_M$, is obtained by finding $\tilde{T}_i, T_j$, j=i+1, . . . M, which minimize $$\tilde{F}_i(\tilde{T}_i, x, v) + \sum_{j=i+1}^{M} F_j(T_j)$$

subject to $$t_{min}(i) \le t_{act} + \tilde{T}_i \le t_{max}(i) - \Delta t_i$$

$$t_{min}(k) \le t_{act} + \tilde{T}_i + \sum_{j=i+1}^{k} (T_j + \Delta t_{j-1}) \le t_{max}(k) - \Delta t_k$$

$$k = i+1, \ldots, M-1$$

$$t_{act} + \tilde{T}_i + \sum_{j=i+1}^{M} (T_j + \Delta t_{j-1}) = T$$

Here, $\tilde{F}_i(t,x,v)$ is the fuel-used of the optimal trip from x to $D_i$, traveled in time t, with initial speed at x of v.

As discussed above, an exemplary way to enable more efficient re-planning is to construct the optimal solution for a stop-to-stop trip from partitioned segments. For the trip from $D_{i-1}$ to $D_i$, with travel time $T_i$, choose a set of intermediate points $D_{ij}$, j=1, . . . , $N_i-1$. Let $D_{i0}=D_{i-1}$ and $D_{iN_i}=D_i$. Then express the fuel-use for the optimal trip from $D_{i-1}$ to $D_i$ as $$F_i(t) = \sum_{j=1}^{N_i} f_{ij}(t_{ij} - t_{i,j-1}, v_{i,j-1}, v_{ij})$$

where $f_{ij}(t,v_{i,j-1},V_{ij})$ is the fuel-use for the optimal trip from $D_{i,j-1}$ to $D_{ij}$, traveled in time t, with initial and final speeds of $v_{i,j-1}$ and $v_{ij}$. Furthermore, $t_{ij}$ is the time in the optimal trip corresponding to distance $D_{ij}$. By definition, $t_{iN_i}-t_{i0}=T_i$. Since the train is stopped at $D_{i0}$ and $D_{iN_i}$, $v_{i0}=V_{iN_i}=0$.

The above expression enables the function $F_i(t)$ to be alternatively determined by first determining the functions $f_{ij}(\cdot)$, $1\le j\le N_i$, then finding $\tau_{ij}$, $1\le j\le N_i$ and $v_{ij}$, $1\le j\le N_i$, which minimize $$F_i(t) = \sum_{j=1}^{N_i} f_{ij}(\tau_{ij}, v_{i,j-1}, v_{ij})$$

subject to $$\sum_{j=1}^{N_i} \tau_{ij} = T_i$$

$$v_{min}(i, j) \le v_{ij} \le v_{max}(i, j) \quad j = 1, \ldots, N_i - 1$$

$$v_{i0} = v_{iN_i} = 0$$

By choosing $D_{ij}$ (e.g., at speed restrictions or meeting points), $v_{max}(i, j)-v_{min}(i, j)$ can be minimized, thus minimizing the domain over which $f_{ij}(\ )$ needs to be known.

Based on the partitioning above, a simpler suboptimal re-planning approach than that described above is to restrict re-planning to times when the train is at distance points $D_{ij}$, $1\le i\le M$, $1\le j\le N_i$. At point $D_{ij}$, the new optimal trip from $D_{ij}$ to $D_M$ can be determined by finding $\tau_{ik}$, $j<k\le N_i$, $v_{ik}$, $j<k<N_i$, and $\tau_{mn}$, $i<m\le M$, $1\le n\le N_m$, $v_{mn}$, $i<m\le M$, $1\le n\le N_m$, which minimize $$\sum_{k=j+1}^{N_i} f_{ik}(\tau_{ik}, v_{i,k-1}, v_{ik}) + \sum_{m=i+1}^{M} \sum_{n=1}^{N_m} f_{mn}(\tau_{mn}, v_{m,n-1}, v_{mn})$$

subject to $$t_{min}(i) \le t_{act} + \sum_{k=j+1}^{N_i} \tau_{ik} \le t_{max}(i) - \Delta t_i$$

$$t_{min}(n) \le t_{act} + \sum_{k=j+1}^{N_i} \tau_{ik} + \sum_{m=i+1}^{n} (T_m + \Delta t_{m-1}) \le t_{max}(n) - \Delta t_n$$

$$n = i+1, \ldots, M-1$$

$$t_{act} + \sum_{k=j+1}^{N_i} \tau_{ik} + \sum_{m=i+1}^{M} (T_m + \Delta t_{m-1}) = T$$

where $$T_m = \sum_{n=1}^{N_m} \tau_{mn}$$

A further simplification is obtained by waiting on the re-computation of $T_m$, $i<m\le M$, until distance point $D_i$ is reached.

In this way, at points $D_{ij}$ between $D_{i-1}$ and $D_{ij}$, the minimization above needs only be performed over $\tau_{ik}$, $j<k\leq N_i$, $v_{ik}$, $j<k<N_i$. $T_i$ is increased as needed to accommodate any longer actual travel time from $D_{i-1}$ to $D^{ij}$ than planned. This increase is later compensated, if possible, by the re-computation of $T_m$, $i<m\leq M$, at distance point $D_i$. When emissions is the factor being optimized, the above equations are still applicable except that a predetermined and/or a real time and/or time varying fuel versus emissions transfer function is used as a substitute. Those skilled in the art will recognize that other transfer functions may be used as well, such as but not limited to fuel versus speed, emissions versus speed, and fuel versus emissions versus speed. When comparing this elements, the term fuel is used to also mean fuel efficiency. Likewise, emissions are used to also mean emissions efficiency.

With respect to the closed-loop configuration disclosed above, the total input energy required to move a train 31 from point A to point B consists of the sum of four components, specifically difference in kinetic energy between points A and B; difference in potential energy between points A and B; energy loss due to friction and other drag losses; and energy dissipated by the application of brakes. Assuming the start and end speeds to be equal (e.g., stationary), the first component is zero. Furthermore, the second component is independent of driving strategy. Thus, it suffices to minimize the sum of the last two components.

Following a constant speed profile minimizes drag loss. Following a constant speed profile also minimizes total energy input when braking is not needed to maintain constant speed. However, if braking is required to maintain constant speed, applying braking just to maintain constant speed will most likely increase total required energy because of the need to replenish the energy dissipated by the brakes. A possibility exists that some braking may actually reduce total energy usage if the additional brake loss is more than offset by the resultant decrease in drag loss caused by braking, by reducing speed variation.

After completing a re-plan from the collection of events described above, the new optimal notch/speed plan can be followed using the closed loop control described herein. However, in some situations there may not be enough time to carry out the segment decomposed planning described above, and particularly when there are critical speed restrictions that must be respected, an alternative is needed. Exemplary embodiments of the present invention accomplish this with an algorithm referred to as "smart cruise control". The smart cruise control algorithm is an efficient way to generate, on the fly, an energy-efficient (hence fuel-efficient and/or emission-efficient) sub-optimal prescription for driving the train 31 over a known terrain. This algorithm assumes knowledge of the position of the train 31 along the track 34 at all times, as well as knowledge of the grade and curvature of the track versus position. The method relies on a point-mass model for the motion of the train 31, whose parameters may be adaptively estimated from online measurements of train motion as described earlier.

The smart cruise control algorithm has three principal components, specifically a modified speed limit profile that serves as an energy-efficient guide around speed limit reductions; an ideal throttle or dynamic brake setting profile that attempts to balance between minimizing speed variation and braking; and a mechanism for combining the latter two components to produce a notch command, employing a speed feedback loop to compensate for mismatches of modeled parameters when compared to reality parameters. Smart cruise control can accommodate strategies in exemplary embodiments of the present invention that does no activate braking (i.e. the driver is signaled and assumed to provide the requisite braking) or a variant that does active braking. The smart cruise control algorithm can also be configured and implemented to accomplish emission efficiency.

With respect to the cruise control algorithm that does not control dynamic braking, the three exemplary components are a modified speed limit profile that serves as an energy-efficient guide around speed limit reductions, a notification signal directed to notify the operator when braking should be applied, an ideal throttle profile that attempts to balance between minimizing speed variations and notifying the operator to apply braking, a mechanism employing a feedback loop to compensate for mismatches of model parameters to reality parameters.

Also included in exemplary embodiments of the present invention is an approach to identify key parameter values of the train 31. For example, with respect to estimating train mass, a Kalman filter, time varying and dependent Taylor series expansion, and a recursive least-squares approach may be utilized to detect errors that may develop over time.

Figure 7:
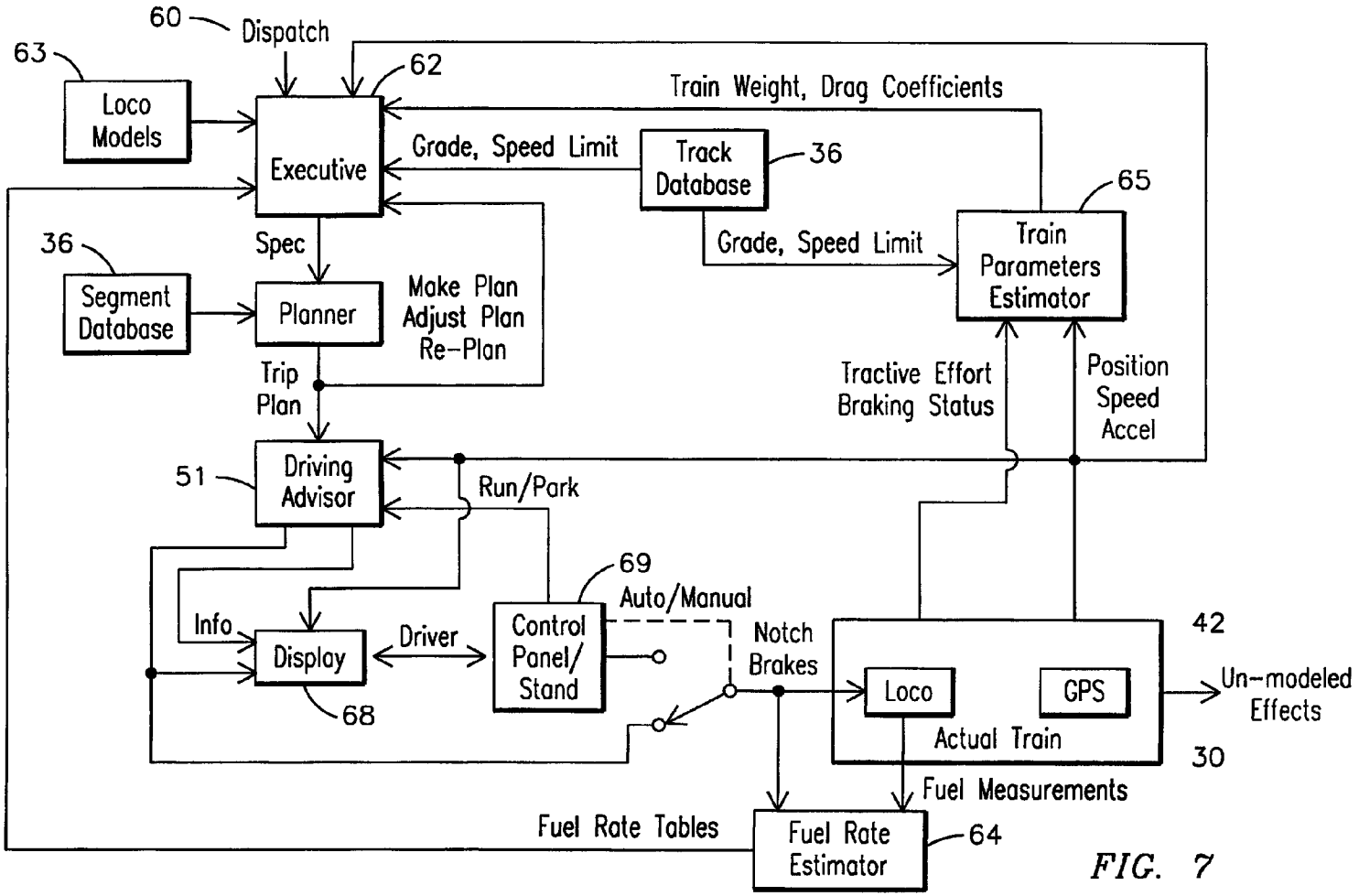
FIG. 7 depicts an exemplary flow chart of the present invention.

FIG. 7 depicts an exemplary flow chart of the present invention. As discussed previously, a remote facility, such as a dispatch 60 can provide information. As illustrated, such information is provided to an executive control element 62. Also supplied to the executive control element 62 is locomotive modeling information database 63, information from a track database 36 such as, but not limited to, track grade information and speed limit information, estimated train parameters such as, but not limited to, train weight and drag coefficients, and fuel rate tables from a fuel rate estimator 64. The executive control element 62 supplies information to the planner 12, which is disclosed in more detail in FIG. 1. Once a trip plan has been calculated, the plan is supplied to a driving advisor, driver or controller element 51. The trip plan is also supplied to the executive control element 62 so that it can compare the trip when other new data is provided.

As discussed above, the driving advisor 51 can automatically set a notch power, either a pre-established notch setting or an optimum continuous notch power. In addition to supplying a speed command to the locomotive 31, a display 68 is provided so that the operator can view what the planner has recommended. The operator also has access to a control panel 69. Through the control panel 69 the operator can decide whether to apply the notch power recommended. Towards this end, the operator may limit a targeted or recommended power. That is, at any time the operator always has final authority over what power setting the locomotive consist will operate at. The trip plan may be modified (not shown) based on the knowledge of signaling information and location of other trains in the system. This information could be obtained from other network velocity/position control systems and part of which may reside outside the train. For example, one such system may include a Positive Train Control (PTC) system, which is an integrated command, control, communications, and information system for controlling train movements with safety, security, precision, and efficiency. Similarly the operator could limit the power based on the above signaling information. This includes deciding whether to apply braking if the trip plan recommends slowing the train 31. For example, if operating in dark territory, or where information from wayside equipment cannot electronically transmit information to a train and instead the operator views visual signals from the wayside equipment, the operator inputs commands based on information contained in track database and visual signals from the wayside equipment. Based on how the train 31 is functioning, information regarding fuel measurement is supplied to the fuel rate estimator 64.

Since direct measurement of fuel flows is not typically available in a locomotive consist, all information on fuel consumed so far within a trip and projections into the future following optimal plans is carried out using calibrated physics models such as those used in developing the optimal plans. For example, such predictions may include but are not limited to, the use of measured gross horse-power and known fuel characteristics to derive the cumulative fuel used.

The train 31 also has a locator device 30 such as a GPS sensor, as discussed above. Information is supplied to the train parameters estimator 65. Such information may include, but is not limited to, GPS sensor data, mile post data, tractive/braking effort data, braking status data, speed and any changes in speed data. With information regarding grade and speed limit information, train weight and drag coefficients information is supplied to the executive control element 62.

Exemplary embodiments of the present invention may also allow for the use of continuously variable power throughout the optimization planning and closed loop control implementation. In a conventional locomotive, power is typically quantized to eight discrete levels. Modern locomotives can realize continuous variation in horsepower which may be incorporated into the previously described optimization methods. With continuous power, the locomotive 42 can further optimize operating conditions, e.g., by minimizing auxiliary loads and power transmission losses, and fine tuning engine horsepower regions of optimum efficiency, or to points of increased emissions margins. Example include, but are not limited to, minimizing cooling system losses, adjusting alternator voltages, adjusting engine speeds, and reducing number of powered axles. Further, the locomotive 42 may use the on-board track database 36 and the forecasted performance requirements to minimize auxiliary loads and power transmission losses to provide optimum efficiency for the target fuel consumption/emissions. Examples include, but are not limited to, reducing a number of powered axles on flat terrain and pre-cooling the locomotive engine prior to entering a tunnel.

Exemplary embodiments of the present invention may also use the on-board track database 36 and the forecasted performance to adjust the locomotive performance, such as to insure that the train has sufficient speed as it approaches a hill and/or tunnel. For example, this could be expressed as a speed constraint at a particular location that becomes part of the optimal plan generation created solving the equation (OP). Additionally, exemplary embodiments of the present invention may incorporate train-handling rules, such as, but not limited to, tractive effort ramp rates, maximum braking effort ramp rates. These may be incorporated directly into the formulation for optimum trip profile or alternatively incorporated into the closed loop regulator used to control power application to achieve the target speed.

In a preferred embodiment the present invention is only installed on a lead locomotive of the train consist. Even though exemplary embodiments of the present invention are not dependant on data or interactions with other locomotives, it may be integrated with a consist manager, as disclosed in U.S. Pat. No. 6,691,957 and U.S. Pat. No. 7,021,588 (owned by the Assignee and both incorporated by reference), functionality and/or a consist optimizer functionality to improve efficiency. Interaction with multiple trains is not precluded as illustrated by the example of dispatch arbitrating two "independently optimized" trains described herein.

Trains with distributed power systems can be operated in different modes. One mode is where all locomotives in the train operate at the same notch command. So if the lead locomotive is commanding motoring—N8, all units in the train will be commanded to generate motoring—N8 power. Another mode of operation is "independent" control. In this mode, locomotives or sets of locomotives distributed throughout the train can be operated at different motoring or braking powers. For example, as a train crests a mountaintop, the lead locomotives (on the down slope of mountain) may be placed in braking, while the locomotives in the middle or at the end of the train (on the up slope of mountain) may be in motoring. This is done to minimize tensile forces on the mechanical couplers that connect the railcars and locomotives. Traditionally, operating the distributed power system in "independent" mode required the operator to manually command each remote locomotive or set of locomotives via a display in the lead locomotive. Using the physics based planning model, train set-up information, on-board track database, on-board operating rules, location determination system, real-time closed loop power/brake control, and sensor feedback, the system shall automatically operate the distributed power system in "independent" mode. Additionally, in a locomotive consist, the remote locomotive may call for more power from the lead locomotive even though the lead locomotive may be operating at a lower power setting. For example, when a train is on a mountain passage, the lead locomotive may be on the downside of a mountain, thus requiring less power, while the remote locomotive is still motoring up the mountain, thus requiring more power.

When operating in distributed power, the operator in a lead locomotive can control operating functions of remote locomotives in the remote consists via a control system, such as a distributed power control element. Thus when operating in distributed power, the operator can command each locomotive consist to operate at a different notch power level (or one consist could be in motoring and other could be in braking) wherein each individual locomotive in the locomotive consist operates at the same notch power. In an exemplary embodiment, with an exemplary embodiment of the present invention installed on the train, preferably in communication with the distributed power control element, when a notch power level for a remote locomotive consist is desired as recommended by the optimized trip plan, the exemplary embodiment of the present invention will communicate this power setting to the remote locomotive consists for implementation. As discussed below, the same is true regarding braking.

Exemplary embodiments of the present invention may be used with consists in which the locomotives are not contiguous, e.g., with 1 or more locomotives up front, others in the middle and at the rear for train. Such configurations are called distributed power wherein the standard connection between the locomotives is replaced by radio link or auxiliary cable to link the locomotives externally. When operating in distributed power, the operator in a lead locomotive can control operating functions of remote locomotives in the consist via a control system, such as a distributed power control element. In particular, when operating in distributed power, the operator can command each locomotive consist to operate at a different notch power level (or one consist could be in motoring and other could be in braking) wherein each individual in the locomotive consist operates at the same notch power.

In an exemplary embodiment, with an exemplary embodiment of the present invention installed on the train, preferably in communication with the distributed power control element, when a notch power level for a remote locomotive consist is desired as recommended by the optimized trip plan, the exemplary embodiment of the present invention will communicate this power setting to the remote locomotive consists for implementation. As discussed below, the same is true regarding braking. When operating with distributed power, the optimization problem previously described can be enhanced to allow additional degrees of freedom, in that each of the remote units can be independently controlled from the lead unit. The value of this is that additional objectives or constraints relating to in-train forces may be incorporated into the performance function, assuming the model to reflect the in-train forces is also included. Thus exemplary embodiments of the present invention may include the use of multiple throttle controls to better manage in-train forces as well as fuel consumption and emissions.

In a train utilizing a consist manager, the lead locomotive in a locomotive consist may operate at a different notch power setting than other locomotives in that consist. The other locomotives in the consist operate at the same notch power setting. Exemplary embodiments of the present invention may be utilized in conjunction with the consist manager to command notch power settings for the locomotives in the consist. Thus based on exemplary embodiments of the present invention, since the consist manager divides a locomotive consist into two groups, lead locomotive and trail units, the lead locomotive will be commanded to operate at a certain notch power and the trail locomotives are commanded to operate at another certain notch power. In an exemplary embodiment the distributed power control element may be the system and/or apparatus where this operation is housed.

Likewise, when a consist optimizer is used with a locomotive consist, exemplary embodiments of the present invention can be used in conjunction with the consist optimizer to determine notch power for each locomotive in the locomotive consist. For example, suppose that a trip plan recommends a notch power setting of 4 for the locomotive consist. Based on the location of the train, the consist optimizer will take this information and then determine the notch power setting for each locomotive in the consist. In this implementation, the efficiency of setting notch power settings over intra-train communication channels is improved. Furthermore, as discussed above, implementation of this configuration may be performed utilizing the distributed control system.

Furthermore, as discussed previously, exemplary embodiment of the present invention may be used for continuous corrections and re-planning with respect to when the train consist uses braking based on upcoming items of interest, such as but not limited to railroad crossings, grade changes, approaching sidings, approaching depot yards, and approaching fuel stations where each locomotive in the consist may require a different braking option. For example, if the train is coming over a hill, the lead locomotive may have to enter a braking condition whereas the remote locomotives, having not reached the peak of the hill may have to remain in a motoring state.

Figure 8:
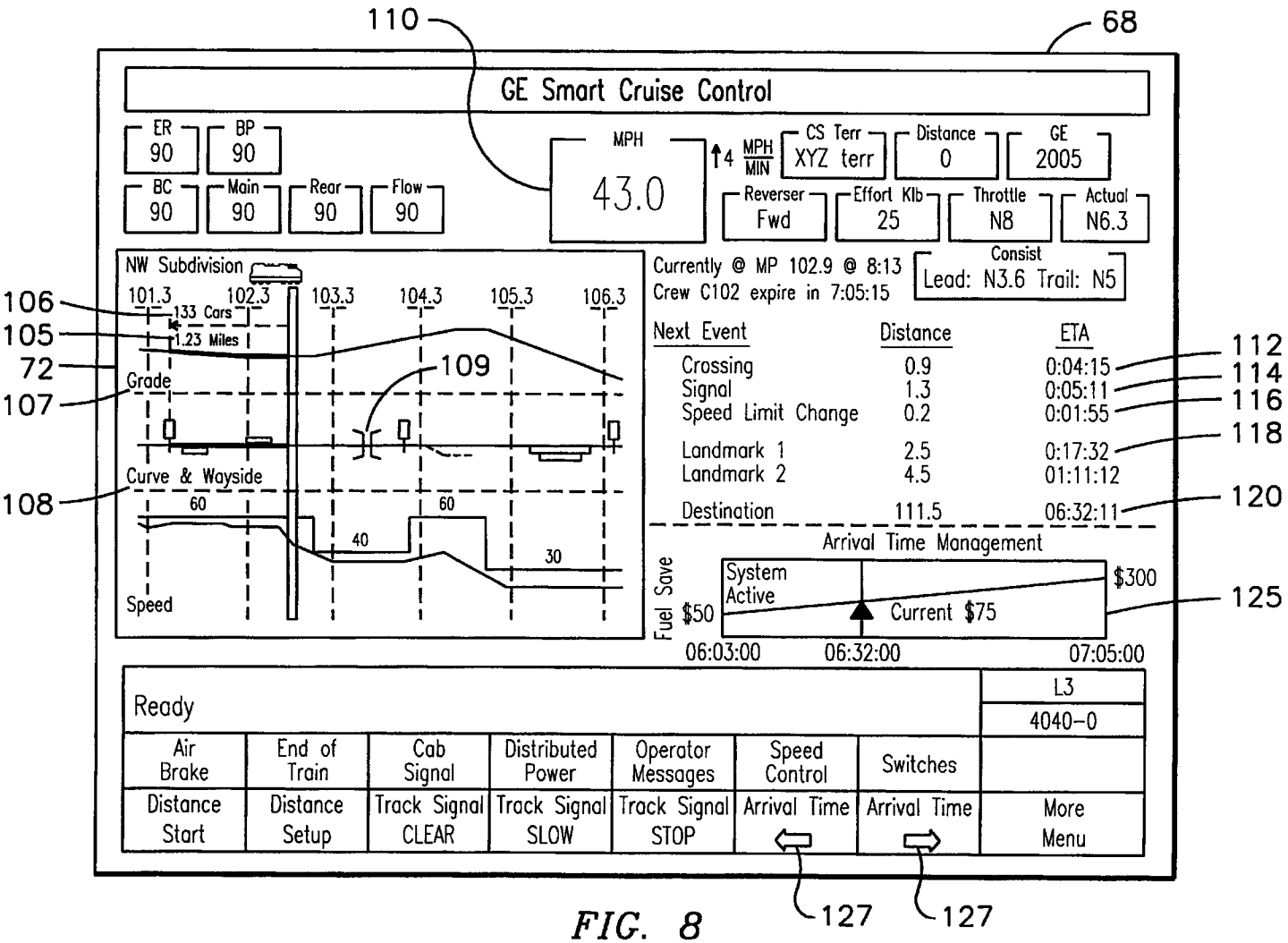
FIG. 8 depicts an exemplary illustration of a dynamic display for use by the operator.
Figure 9:
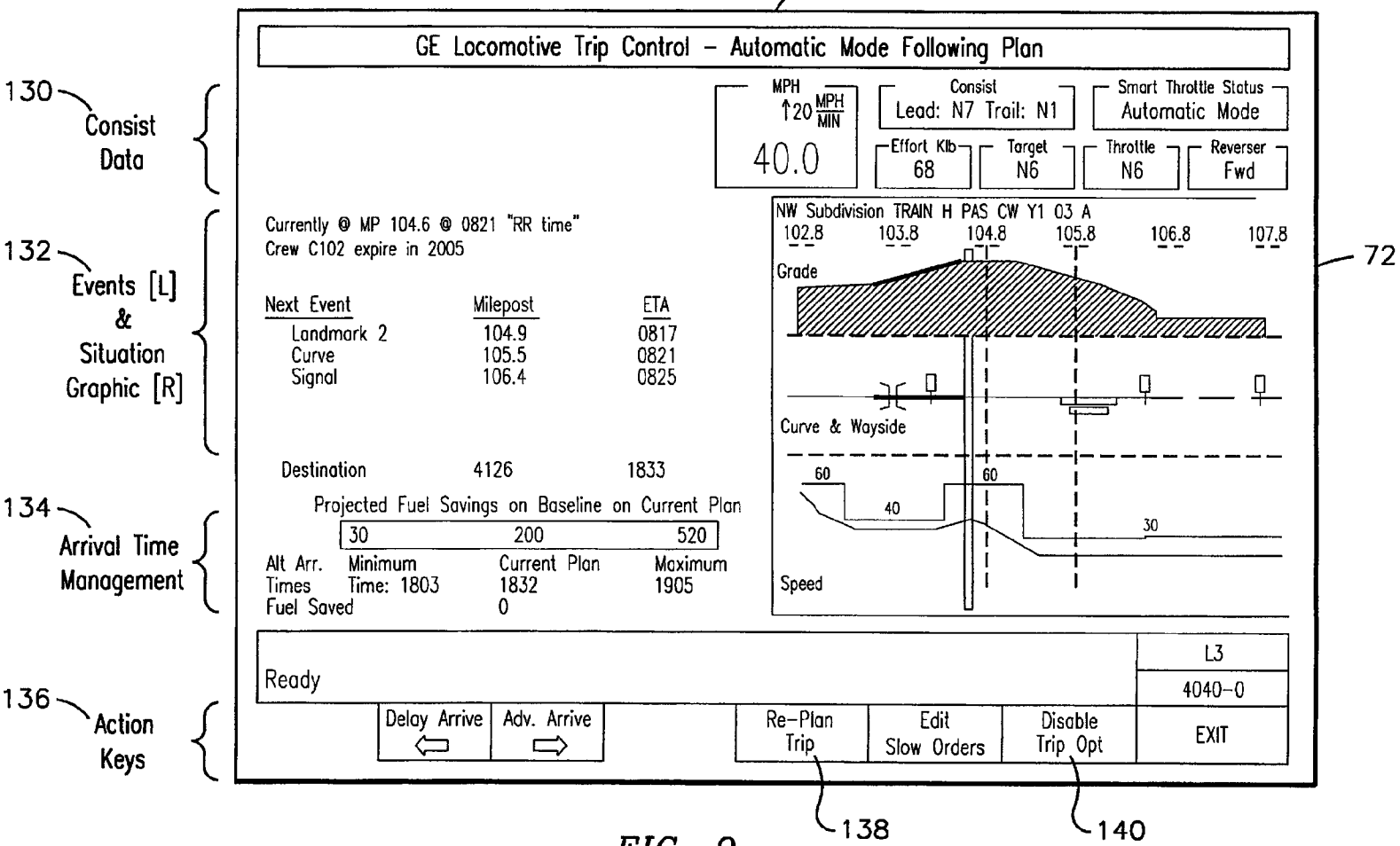
FIG. 9 depicts another exemplary illustration of a dynamic display for use by the operator.
Figure 10:
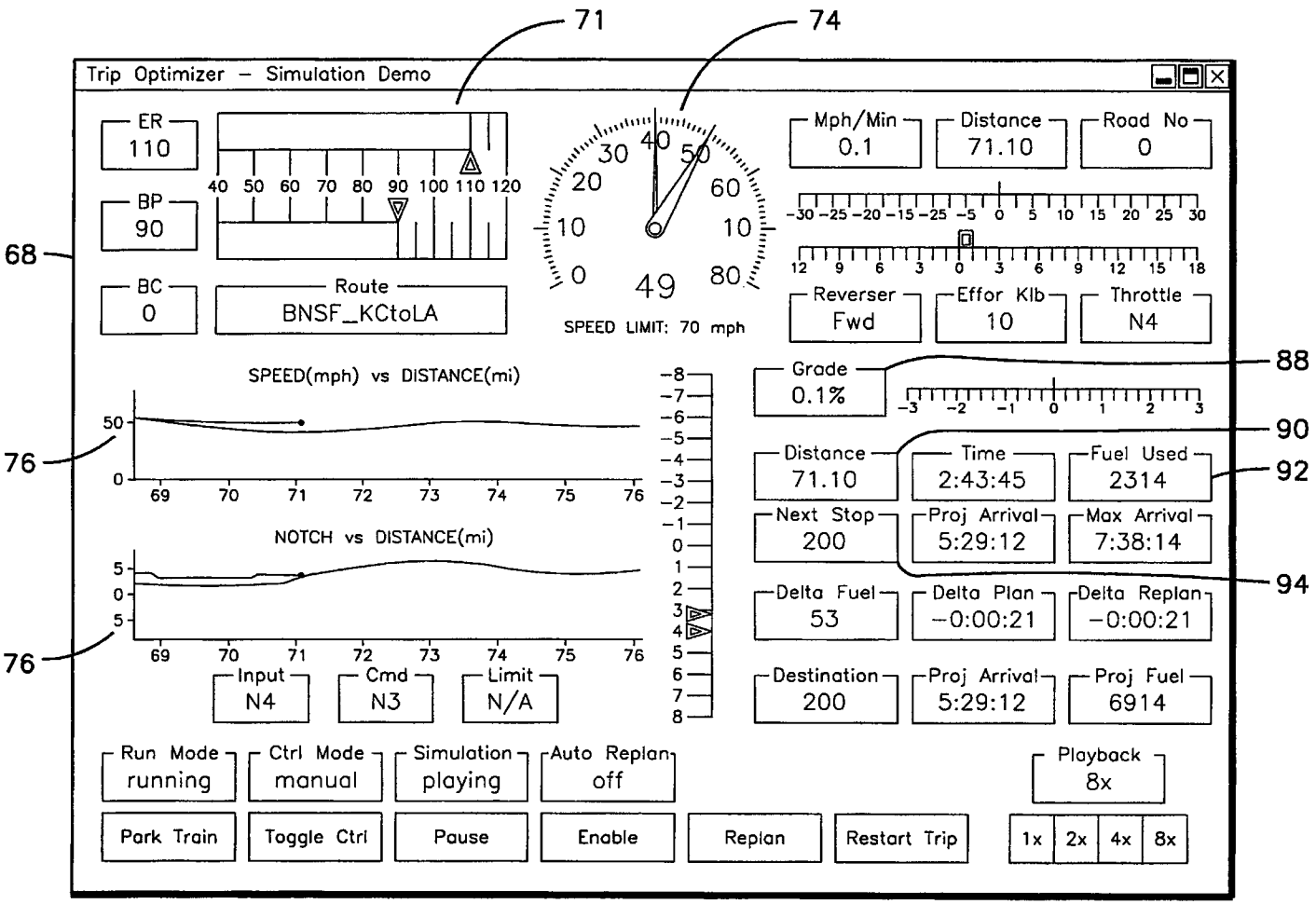
FIG. 10 depicts another exemplary illustration of a dynamic display for use by the operator.

FIGS. 8, 9 and 10 depict exemplary illustrations of dynamic displays for use by the operator. As provided, FIG. 8, a trip profile is provided 72. Within the profile a location 73 of the locomotive is provided. Such information as train length 105 and the number of cars 106 in the train is provided. Elements are also provided regarding track grade 107, curve and wayside elements 108, including bridge location 109, and train speed 110. The display 68 allows the operator to view such information and also see where the train is along the route. Information pertaining to distance and/or estimate time of arrival to such locations as crossings 112, signals 114, speed changes 116, landmarks 118, and destinations 120 is provided. An arrival time management tool 125 is also provided to allow the user to determine the fuel savings that is being realized during the trip. The operator has the ability to vary arrival times 127 and witness how this affects the fuel savings. As discussed herein, those skilled in the art will recognize that fuel saving is an exemplary example of only one objective that can be reviewed with a management tool. Towards this end, depending on the parameter being viewed, other parameters (or factors such as emissions), discussed herein can be viewed and evaluated with a management tool that is visible to the operator. Furthermore the comparisons or tradeoff graphs regarding at least fuel and/or emissions may also be displayed, though not shown. The operator is also provided information about how long the crew has been operating the train. In exemplary embodiments time and distance information may either be illustrated as the time and/or distance until a particular event and/or location or it may provide a total elapsed time.

As illustrated in FIG. 9 an exemplary display provides information about consist data 130, an events and situation graphic 132, an arrival time management tool 134, and action keys 136. Similar information as discussed above is provided in this display as well. This display 68 also provides action keys 138 to allow the operator to re-plan as well as to disengage 140 exemplary embodiments of the present invention.

FIG. 10 depicts another exemplary embodiment of the display. Data typical of a modern locomotive including airbrake status 72, analog speedometer with digital inset 74, and information about tractive effort in pounds force (or traction amps for DC locomotives) is visible. An indicator 74 is provided to show the current optimal speed in the plan being executed as well as an accelerometer graphic to supplement the readout in mph/minute. Important new data for optimal plan execution is in the center of the screen, including a rolling strip graphic 76 with optimal speed and notch setting versus distance compared to the current history of these variables. In this exemplary embodiment, location of the train is derived using the locator element. As illustrated, the location is provided by identifying how far the train is away from its final destination, an absolute position, an initial destination, an intermediate point, and/or an operator input.

The strip chart provides a look-ahead to changes in speed required to follow the optimal plan, which is useful in manual control, and monitors plan versus actual during automatic control. As discussed herein, such as when in the coaching mode, the operator can either follow the notch or speed suggested by exemplary embodiments of the present invention. The vertical bar gives a graphic of desired and actual notch, which are also displayed digitally below the strip chart. When continuous notch power is utilized, as discussed above, the display will simply round to closest discrete equivalent, the display may be an analog display so that an analog equivalent or a percentage or actual horse power/tractive effort is displayed.

Critical information on trip status is displayed on the screen, and shows the current grade the train is encountering 88, either by the lead locomotive, a location elsewhere along the train or an average over the train length. A distance traveled so far in the plan 90, cumulative fuel used 92, where or the distance away the next stop is planned 94, current and projected arrival time 96 expected time to be at next stop are also disclosed. The display 68 also shows the maximum possible time to destination possible with the computed plans available. If a later arrival was required, a re-plan would be carried out. Delta plan data shows status for fuel and schedule ahead or behind the current optimal plan. Negative numbers mean less fuel or early compared to plan, positive numbers mean more fuel or late compared to plan, and typically tradeoff in opposite directions (slowing down to save fuel makes the train late and conversely).

At all times these displays 68 gives the operator a snapshot of where he stands with respect to the currently instituted driving plan. This display is for illustrative purpose only as there are many other ways of displaying/conveying this information to the operator and/or dispatch. Towards this end, the information disclosed above could be intermixed to provide a display different than the ones disclosed.

Other features that may be included in exemplary embodiments of the present invention include, but are not limited to, allowing for the generating of data logs and reports. This information may be stored on the train and downloaded to an off-board system at some point in time. The downloads may occur via manual and/or wireless transmission. This information may also be viewable by the operator via the locomotive display. The data may include such information as, but not limited to, operator inputs, time system is operational, fuel saved, fuel imbalance across locomotives in the train, train journey off course, system diagnostic issues such as if GPS sensor is malfunctioning.

Since trip plans must also take into consideration allowable crew operation time, exemplary embodiments of the present invention may take such information into consideration as a trip is planned. For example, if the maximum time a crew may operate is eight hours, then the trip shall be fashioned to include stopping location for a new crew to take the place of the present crew. Such specified stopping locations may include, but are not limited to rail yards, meet/pass locations, etc. If, as the trip progresses, the trip time may be exceeded, exemplary embodiments of the present invention may be overridden by the operator to meet criteria as determined by the operator. Ultimately, regardless of the operating conditions of the train, such as but not limited to high load, low speed, train stretch conditions, etc., the operator remains in control to command a speed and/or operating condition of the train.

Using exemplary embodiments of the present invention, the train may operate in a plurality of operations. In one operational concept, an exemplary embodiment of the present invention may provide commands for commanding propulsion, dynamic braking. The operator then handles all other train functions. In another operational concept, an exemplary embodiment of the present invention may provide commands for commanding propulsion only. The operator then handles dynamic braking and all other train functions. In yet another operational concept, an exemplary embodiment of the present invention may provide commands for commanding propulsion, dynamic braking and application of the airbrake. The operator then handles all other train functions.

Exemplary embodiments of the present invention may also be used by notify the operator of upcoming items of interest of actions to be taken. Specifically, the forecasting logic of exemplary embodiments of the present invention, the continuous corrections and re-planning to the optimized trip plan, the track database, the operator can be notified of upcoming crossings, signals, grade changes, brake actions, sidings, rail yards, fuel stations, etc. This notification may occur audibly and/or through the operator interface.

Specifically using the physics based planning model, train set-up information, on-board track database, on-board operating rules, location determination system, real-time closed loop power/brake control, and sensor feedback, the system shall present and/or notify the operator of required actions. The notification can be visual and/or audible. Examples include notifying of crossings that require the operator activate the locomotive horn and/or bell, notifying of "silent" crossings that do not require the operator activate the locomotive horn or bell.

In another exemplary embodiment, using the physics based planning model discussed above, train set-up information, on-board track database, on-board operating rules, location determination system, real-time closed power/brake control, and sensor feedback, exemplary embodiments of the present invention may present the operator information (e.g. a gauge on display) that allows the operator to see when the train will arrive at various locations as illustrated in FIG. 9. The system shall allow the operator to adjust the trip plan (target arrival time). This information (actual estimated arrival time or information needed to derive off-board) can also be communicated to the dispatch center to allow the dispatcher or dispatch system to adjust the target arrival times. This allows the system to quickly adjust and optimize for the appropriate target function (for example trading off speed and fuel usage).

Figure 11:
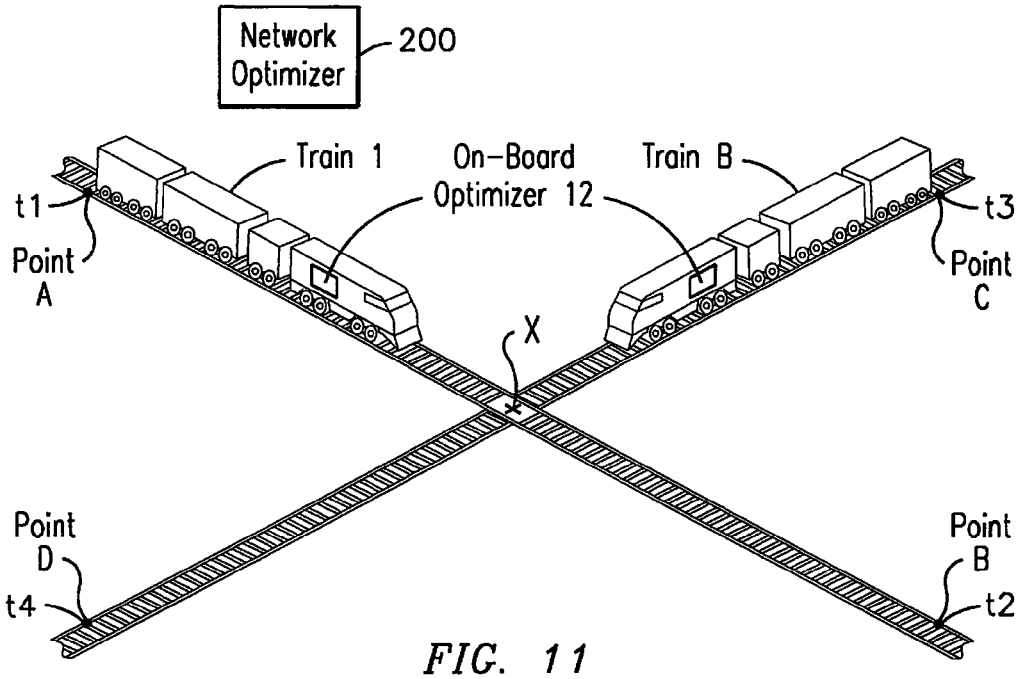
FIG. 11 depicts an exemplary embodiment of a network of railway tracks.

FIG. 11 depicts an exemplary embodiment of two trains on tracks that cross. In an exemplary embodiment a network optimizer 200 allows periodic updates to desired railroad sections and corresponding trains/crews to be obtained and forwarded to the crews for action. If the network optimizer 200 has additional train information such as real time train performance data including, but not limited to maximum acceleration, speed, fuel efficiency, emissions optimization etc., a more optimum network performance can be optioned.

For example, as illustrated suppose that train 1 departs point A at time t1 and is scheduled to arrive at point B at time t2. Train 2 departs at time t3 from point C and is scheduled to arrive at point D at time t4. The two tracks intersect at point X. Though point X is illustrated as a fixed point, those skilled in the art will readily recognize that point X may be a sliding point. Furthermore, though intersecting tracks are illustrated in FIG. 11, those skilled in the art will readily recognize that an exemplary embodiment of the invention may be used when siding a train in order to accomplish a meet/pass. Thus, point X could be considered a side track available for use with the meet/pass.

It is desirable to ensure that the two trains, train 1 and train 2, do not intersect at the same time. The time of arrival t2 or t4 may change depending on the network optimizer predictions. Furthermore train 1 and train 2 generally may have different performance characteristics with respect to fuel efficiency, acceleration capability, speed, etc and these need to be taken into account when running a general network optimization routine. For simplicity, assuming that the time of arrival is fixed for both train 1 and train 2, train 1 travels along track sections AX and XB, where the total travel time is t2−t1, whereas train 2 travels along track sections CX and XD where the total travel time is t4−t3.

Knowing what the projected train speed is for both trains, train 1 and train 2, a range of solutions can be found to ensure that the train 1 and train 2 do not reach the intersecting point X at the same time. The projected speed of train 1 and train 2 can be adjusted within the constraints of each train's capability. The respective trains determine their fuel and speed projections as each train proceeds along its respective track, as disclosed above with respect to the train optimizer system and method disclosed above. Similarly, when emissions is the factor that the trip plans are based on, the respective trains determine their emissions and speed projections as each train proceeds along its respective track, as disclosed above with respect to the train optimizer system and method disclosed above.

In another exemplary embodiment the performance data for each train, train 1 and train 2, is predetermined and may be updated during the run. In another exemplary embodiment each train, train 1 and train 2, provides its respective updated performance data to a network optimizer 200 and the network optimizer 200 recalculates the overall network performance and efficiency. In another exemplary embodiment, the network optimizer 200 uses the projected speed in place of performance data. Implementation of the exemplary embodiment of the invention may occur and be evaluated locally on board the train, globally off board, such as at remote location, in regions or combinations of the above. As disclosed above, the performance data may be based on at least one parameter and/or factor, such as but not limited to fuel, emissions, etc.

In another exemplary embodiment the trains, train 1 and train 2, also provide fuel efficiency versus speed, versus acceleration capability data to provide the network optimizer 200 with additional data to trade network fuel efficiency and performance off against local train performance parameters. The network optimizer 200 then provides each train with updated intersection and final time of arrival data and each individual train adjusts it's characteristics for local optimization. As time progresses, the set of solutions is reduced and the local optimization and performance overwrites network performance optimization desires.

In another exemplary embodiment, at time of departure of train 1 it is scheduled to arrive at intersection X prior to train 2, given an optimum train 1 fuel efficiency of both sections AX and XB. Given, by example, that train 2 has a local optimized fuel efficiency of sections CX and CD and that both trains intersect at point X, the network optimizer 200, with the knowledge of fuel efficiency of train 1 and train 2 versus speed and possible acceleration/deceleration, is able to trade off fuel efficiency of train 1 versus fuel efficiency of train 2 to avoid both trains arriving at intersection X at the same time. The network optimizer 200 then provides the feedback to the local trains, train 1 and train 2, for overall efficiency. This may include having one of the two trains, train 1 or train 2, coming to a stop prior to reaching the intersection X. If time of arrival changes for either train, the optimum projection for each individual train and overall network may be adjusted.

The exemplary embodiments provide a framework to allow local optimization while also providing global optimization. In a preferred embodiment the data exchange between the local train optimizer 12 and network optimizer 200 must occur. The network optimizer 200 has an initial set of train parameters for network optimization. In an exemplary embodiment the initial set of parameters includes projected fuel efficiency based on train makeup parameters. In another exemplary embodiment the initial dataset is based on historical data, from standard tables, and/or from hand calculations and/or operator input.

The network optimizer 200 determines an initial time of arrival and speed settings for both trains, train 1 and train 2. In one preferred embodiment the train(s) optimizes its speed using a trip optimizer system 12 and feeds the resulting performance parameters back to the network optimizer 200. In an exemplary embodiment if the train, train 1 and/or train 2, does not have a trip optimizer system, the train, train 1 and/or train 2 provides train data such as speed, fuel use and power settings to the network optimizer 200 to perform an approximate fuel efficiency or train performance calculation. The network optimizer 200 recalculates network efficiency given the updated data sets and provides updated targets to the local train, train 1 and/or train 2. Additionally, other network or train parameters, such as remaining crew time, train health, track conditions, cargo parameters, car parameters such as cooling capability for food loads, etc, can be added as constraints and provide different local target arrival values.

As time progresses, the local train capability provides a more constraint solution as compared to network options. By way of example, local track occupancy or speed restrictions may limit the train, train 1 and/or train 2, to maintain a certain speed or accelerate to progress to a waypoint as desired by the network optimizer 200. In that condition, the local train constraint may overwrite the desire of the network and must be taken as a hard limit to the network optimization routine.

In an exemplary embodiment the result associated with changing the speed of the local train, train 1 and/or train 2, is increased thus making it less desirable or impossible for the network optimizer 200 to push past this local constraint. Another consideration that may be considered is that as additional trains are added to the track network, the initial option setting for each additional local train in general is less restrictive as towards the end of a train journey of a previously departed train. Furthermore it is understood that trains can be put into different priority categories such as 'Z'-trains. Towards this end, the above-discussed exemplary embodiments may apply to trains with various priorities where the local train parameters are adjusted accordingly.

Figure 12:
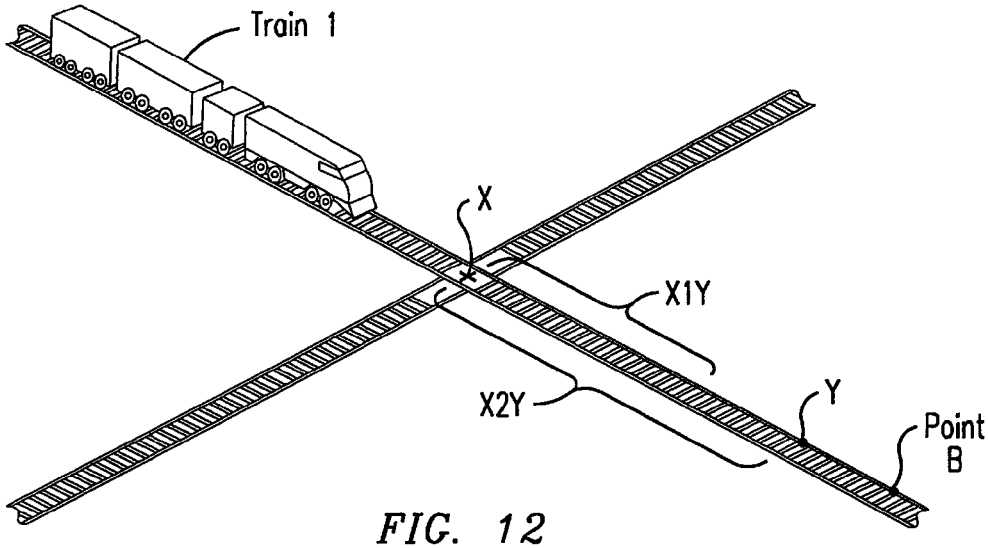
FIG. 12 depicts another exemplary embodiment of a network of railway tracks.

In another exemplary embodiment, the embodiments discussed above can be used to evaluate an option of the train, train 1 and/or train 2, traveling along at least 2 different path options. In this embodiment as illustrated in FIG. 12, at least two incremental sections and crossing point Y are provided. The evaluation is extended to section AX, where the train t1 can travel along at least 2 alternate paths, X1Y and X2Y, progress to the intersection Y where the track combines and then traverses to its final destination B. The above situation can occur where older and newer tracks are built to facilitate faster throughput. The local optimizer 12 calculates the projected efficiency (fuel and/or emissions) for both options and presents these to the network optimizer 200 for evaluation. In one exemplary embodiment the priority of a stacked train, train 3, traversing the same overall mission AB can then be evaluated against train 1 and also against train 2.

In another exemplary embodiment, alternate trip routes for the train, train 1 and/or train 2, are determined, such as but not limited to by information provided by the trip optimizer, disclosed above, to the network optimizer 200. Also, alternate routes may be calculated onboard the train, train 1 and/or train 2. Thus in operation, if an alternate trip route is determined to insure that the train, train 1 and/or train 2, meets its mission trip time objective, when crossing another track, the train, train 1 and/or train 2, may transition to the other track if transitioning will assist in meeting the mission trip time objective. The network optimizer 200 can then be used to insure that by switching tracks no other rail vehicles are affected. Towards this end, such information as maintenance and/or repair work may also be provided to the network optimizer 200 to insure proper operation of the railways.

Figure 13:
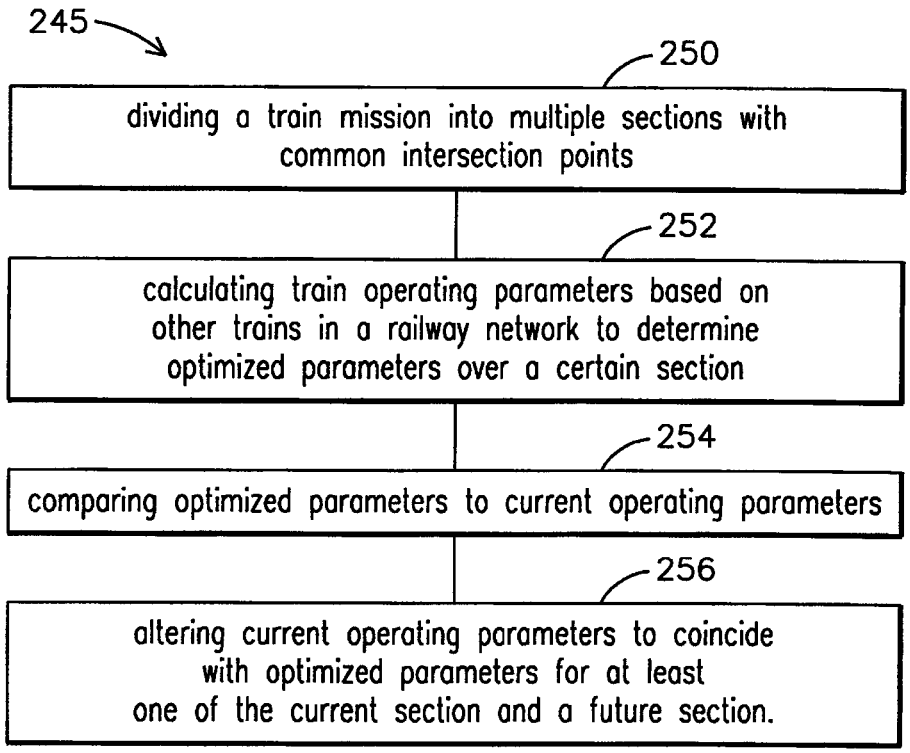
FIG. 13 depicts a flowchart illustrating exemplary steps for linking certain parameters with network knowledge.

FIG. 13 depicts a flowchart illustrating exemplary steps for linking certain parameters with network knowledge. As illustrated in the flowchart 245, a step provides for dividing the train mission into multiple sections with common intersection points is disclosed, step 250. Train operating parameters are calculated based on other trains in the railway network to determine optimized parameters over a certain section, step 252. The optimized parameters are compared to current operating parameters, step 254. The current operating parameters are altered to coincide with optimized parameters for the current track section and/or a future track section. The operating parameters include, but are not limited to, fuel parameters and/or speed parameters. In an exemplary embodiment the current operating parameters are optimized parameters that are determined by the train, train 1 and/or train 2. Furthermore, current operating parameters may be altered to avoid conflicts with other trains.

Figure 14:
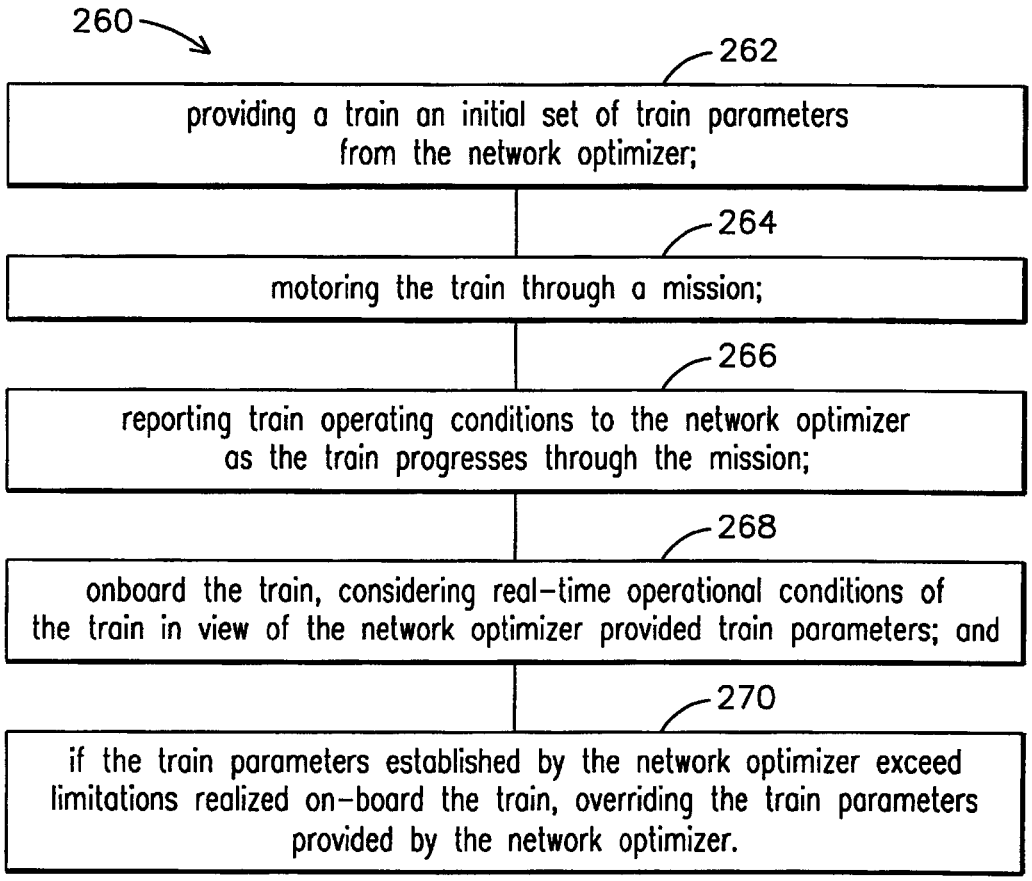
FIG. 14 depicts a flowchart illustrating exemplary steps for linking certain parameters with network knowledge.

FIG. 14 depicts another flowchart illustrating exemplary steps linking certain parameters with network knowledge. On step in the flowchart 260 discloses a train is provided with an initial set of train parameters from the network optimizer, step 262. The train motors through a mission, step 264. The train operating conditions are reported to the network optimizer as the train progresses through the mission, step 266. On-board the train, consideration of real-time operational conditions of the train in view of the network optimizer provided train parameters is disclosed, step 268. If the train parameters established by the network optimizer exceed limitations realized on-board the train, the train parameters provided by the network optimizer is overridden, step 270.

Based on the foregoing specification and as previously discussed above, exemplary embodiments of the invention may be implemented using computer programming and/or engineering techniques including computer software, firmware, hardware or any combination or subset thereof. Towards this end, the flow charts 245, 260 discussed above may be implemented using a computer software code.

Figure 15:
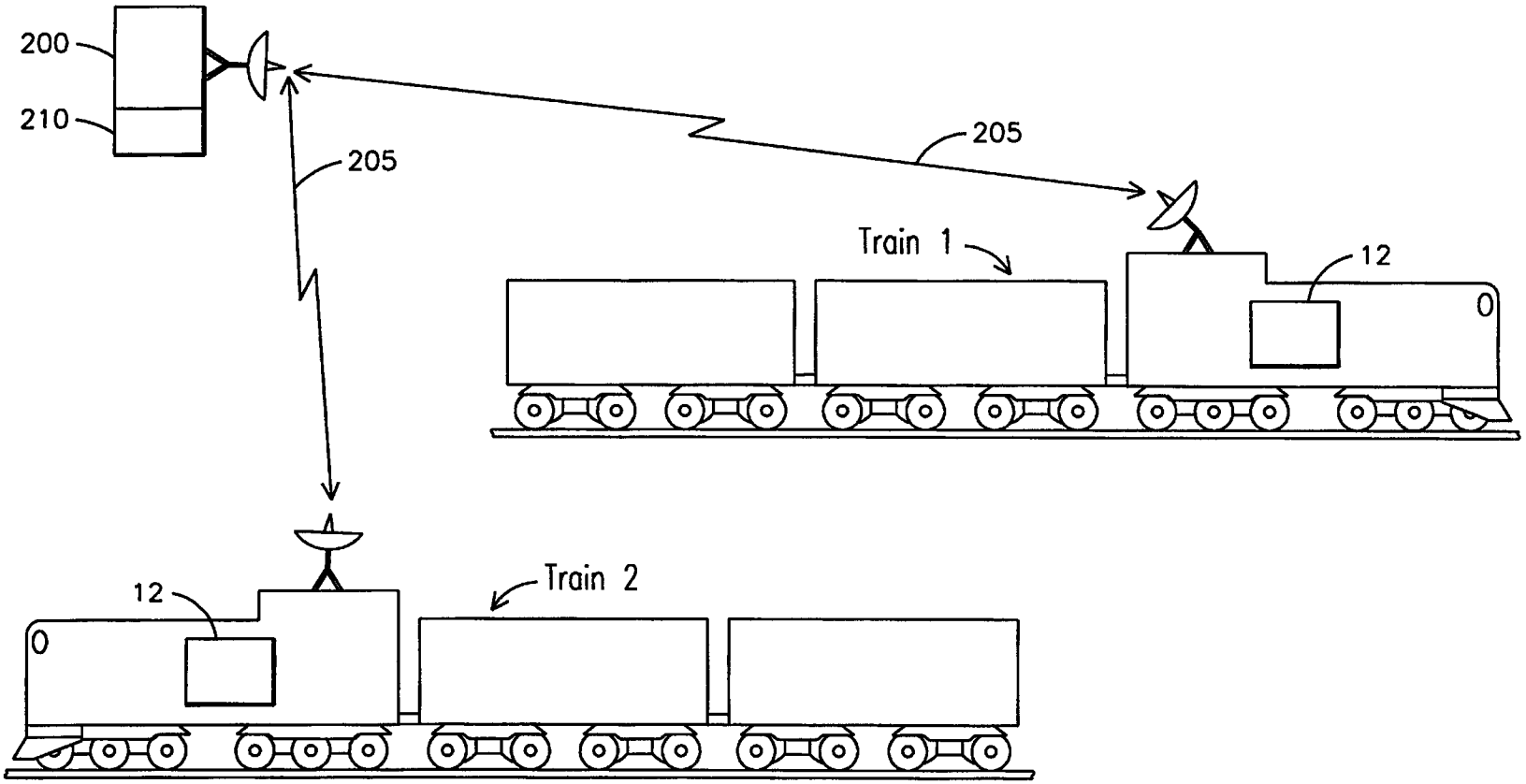
FIG. 15 depicts a block diagram of exemplary elements that may be part of a system for optimizing a train's operations within a network of railway tracks.

FIG. 15 depicts a block diagram of exemplary elements that may be part of a system for optimizing a train's operations within a network of railway tracks. As illustrated, a network optimizer 200 that determines optimum operating conditions for a plurality of trains, train 1 and/or train 2, within a railway network over segments of each trains' mission is provided. A wireless communication system 205 providing for communicating between the network optimizer 200 and the train, train 1 and/or train 2 is also provided. A data collection system 210 that provides operational conditions about the train, train 1 and/or train 2 to the network optimizer 200 is also provided. Though illustrated as being proximate the network optimizer 200, those skilled in the art will readily recognize that the data collection system 210 can be a plurality of locations including, but not limited to, individual systems on each train, train 1 and/or train 2, and/or at a depot (not illustrated). When located aboard the train, train 1 and/or train 2, the data collection system 210 may include an on-board trip optimizer 12 that determines optimum operating conditions for the train, train 1 and/or train 2, based on the train's mission. Furthermore, the network optimizer 200 may vary the optimum operating conditions determined by the on-board optimizer 12 for the train, train 1 and/or train 2, in accordance with the optimum operating conditions determined by the network optimizer 200.

Figure 16:
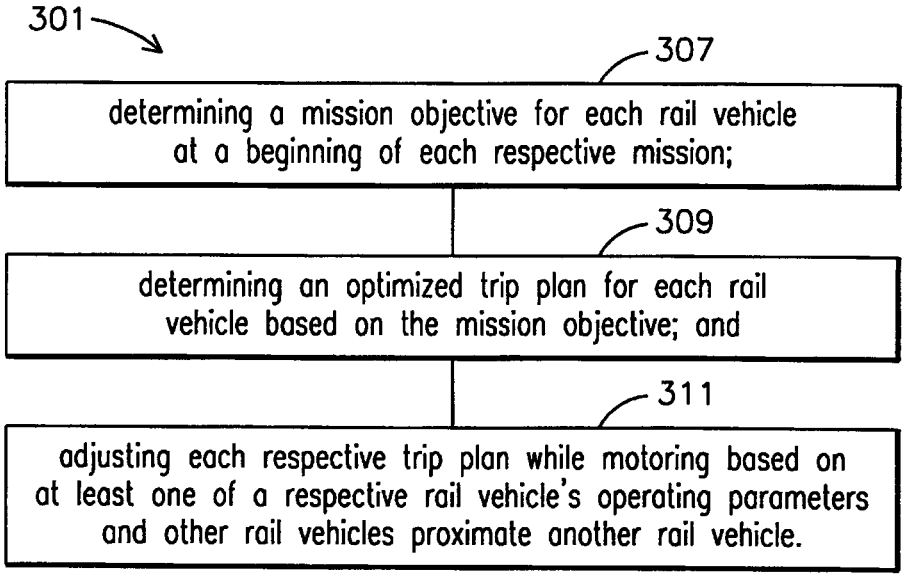
FIG. 16 depicts a flowchart of steps for optimizing a plurality of rail vehicles operating within the railway network.

FIG. 16 depicts a flowchart of steps for optimizing a plurality of rail vehicles operating within the railway network. One step within the flowchart 301 involves determining a mission objective for each rail vehicle at a beginning of each respective mission, step 307. An optimized trip plan is determined for each rail vehicle based on the mission objective, step 309. Each respective trip plan is adjusted while motoring based on a respective rail vehicle's operating parameters and/or other rail vehicles proximate another rail vehicle, step 311.

As disclosed above with respect to the other flow charts in FIGS. 13 and 14, the operating parameters may include at least one fuel parameters and/or speed parameters. Furthermore, current operating parameters are optimized parameters by the rail vehicle (or train) and/or a central network optimizer. Therefore in operation a first respective rail vehicle may be directed to pull onto a side track for a meet and pass based on a priority mission of a second respective rail vehicle. Additionally current operating parameters of a respective rail vehicle may be altered to avoid a conflict with another rail vehicle using the railway network. This altering may be performed by a trip optimizer aboard the rail vehicle.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A method comprising:

obtaining input for planning one or more trip profiles for a first powered vehicle to follow during a trip along a first route to an end location, the input including one or more of a position of the first powered vehicle, a consist description of the first powered vehicle, a power description of the first powered vehicle, a performance of traction transmission of the first powered vehicle, a consumption of engine fuel as a function of output power of the first powered vehicle, emissions of the first powered vehicle as a function of a power setting, a cooling characteristic of the first powered vehicle, an intended trip route along the first route to the end location, a grade in the first route, a curvature in the first route, a makeup of the first powered vehicle, a drag coefficient of the first powered vehicle, a start time, a start location, the end location, a designated travel time, an operator identification, a crew shift expiration time, or the first route;

using one or more processors and the input that is obtained, computing a first trip profile for the first powered vehicle to follow during the trip along the first route to the end location, the first trip profile dictating operational settings of the first powered vehicle as a function of at least one of time or distance along the trip, the first trip profile determined by identifying throttle settings of the first powered vehicle that cause the first powered vehicle to travel along the first route subject to at least one of operating constraints of the first powered vehicle, scheduling constraints of a schedule of the first powered vehicle, or one or more speed limit constraints;

predicting a projected arrival time of a second powered vehicle at a designated location along the first route of the trip of the first powered vehicle while the second powered vehicle is moving toward the designated location; and modifying one or more of the operational settings of the first trip profile based on the projected arrival time of the second powered vehicle that is predicted in order to re-plan the first trip profile into a modified trip profile for the first powered vehicle, wherein traveling according to the operational settings of the first trip profile or the modified trip profile causes the first powered vehicle to reduce at least one of fuel consumed or emissions generated by the first powered vehicle during the trip relative to traveling according to a different trip profile that is different from the first trip plan and the modified trip plan, wherein the first trip profile and the modified trip profile are different from the different trip profile in that the first trip profile is determined and the modified trip profile is created using the at least one of operating constraints, scheduling constraints, or one or more speed limit constraints, and the different trip plan is created using one or more different, second constraints on the travel of the first powered vehicle that are not the same as the at least one of the operating constraints, scheduling constraints, or one or more speed limit constraints, wherein the at least one of operating constraints, scheduling constraints, or one or more speed limit constraints that is used to determine the first trip profile and to create the modified trip profile includes a limitation on an amount of emissions generated by the first powered vehicle during the trip and the one or more different, second constraints include a limitation on a time for the first powered vehicle to travel to the end location but do not include the limitation on the amount of emissions generated by the first powered vehicle.

2. The method of claim 1, wherein predicting the projected arrival time includes comparing at least one of emissions generated by the first powered vehicle or emissions generated by the second powered vehicle to a moving speed of the other of the first powered vehicle or the second powered vehicle, a fuel efficiency of the first powered vehicle or the second powered vehicle to the moving speed of the other of the first powered vehicle or the second powered vehicle, or the emissions generated by the first powered vehicle or the second powered vehicle to the fuel efficiency of the other of the first powered vehicle or the second powered vehicle.

3. The method of claim 2, wherein predicting the projected arrival time is based on comparing the at least one of the emissions generated to the moving speed, the fuel efficiency to the moving speed, or the emissions generated to the fuel efficiency.

4. The method of claim 1, wherein modifying the one or more operational settings of the first trip profile occurs onboard the first powered vehicle.

5. The method of claim 1, wherein modifying the one or more operational settings of the first trip profile is performed to avoid conflicts with other powered vehicles using the route.

6. The method of claim 5, wherein modifying the one or more operational settings is based on relative priorities between scheduled arrival times associated with the first powered vehicle and the second powered vehicle.

7. The method of claim 1, wherein the operational settings include one or more of throttle settings, brake settings, moving speeds, tractive effort, or power output of the first powered vehicle.

8. The method of claim 1, wherein modifying the one or more operational settings of the first trip profile includes modifying the one or more operational settings so that the first powered vehicle avoids occupying a common location along the first route with the second powered vehicle.

9. The method of claim 1, wherein the common location along the first route includes an intersection between the first route being traveled by the first powered vehicle and a different, second route being traveled by the second powered vehicle.

10. The method of claim 8, wherein modifying the one or more operational settings of the first trip profile includes changing a projected arrival time of the first powered vehicle at the common location.

11. The method of claim 1, wherein the first powered vehicle and the second powered vehicle are scheduled to participate in a meet and pass at a common location along the first route, and wherein modifying the one or more operational settings of the first trip profile includes changing the throttle settings of the first powered vehicle to cause the first powered vehicle to travel faster toward the common location, the one or more operational settings modified responsive to monitoring the at least one of the projected moving speed or the projected arrival time of the second powered vehicle and determining that at least one of the first powered vehicle or the second powered vehicle will arrive late to the common location for the meet and pass.

12. The method of claim 1, wherein the first powered vehicle and the second powered vehicle are mechanically decoupled from each other.

13. The method of claim 1, wherein the different trip profile includes one or more different operational settings that are not the same operational settings as the operational settings of the first trip profile or the operational settings of the modified trip profile.

14. The method of claim 1, wherein the at least one of operating constraints, scheduling constraints, or one or more speed limit constraints that is used to determine the first trip profile and to create the modified trip profile includes limitation on an amount of fuel consumed by the first powered vehicle during the trip and the one or more different, second constraints include a limitation on a time for the first powered vehicle to travel to the end location but do not include the limitation on the amount of emissions generated by the first powered vehicle.

15. The method of claim 1, wherein the first trip profile and the modified trip profile are different from the different trip profile in that the first trip profile and the modified trip profile designate the operational settings for travel of the first powered vehicle for the trip and the different trip profile represents manual control of the operational settings for travel of the first powered vehicle.

16. The method of claim 1, wherein the first trip profile and the modified trip profile are different from the different trip profile in that the first trip profile and the modified trip profile designate one or more arrival times of the first powered vehicle at the end location that are not at the same time as an arrival time of the first powered vehicle at the end location that is designated by the different trip profile.

17. The method of claim 1, wherein the first trip profile and the modified trip profile are different from the different trip profile in that the first trip profile and the modified trip profile direct the first powered vehicle to follow the first route to the end location and the different trip profile directs the first powered vehicle to follow a different, second route to the end location.

18. The method of claim 1, further comprising predicting a projected moving speed of the second powered vehicle along the first route of the trip of the first powered vehicle while the second powered vehicle is moving toward the designated location, wherein the one or more operational settings of the first trip profile also are modified based on the projected moving speed that is predicted.

* * * * *